US007374443B2

(12) United States Patent
Saitou et al.

(10) Patent No.: US 7,374,443 B2
(45) Date of Patent: May 20, 2008

(54) 360° ELECTRICAL CONTACT WITHIN A VACUUM CLEANER HOSE

(75) Inventors: Kazuo Saitou, Hyogo-ken (JP); Yuji Fujiwara, Himeji (JP); Hiroyuki Takami, Kasai (JP); Shinichi Hagino, Himeji (JP); Hirotaka Shikano, Kasai (JP)

(73) Assignee: Sanyo Electric Co, Ltd., Moriguchi-Shi, Osaka-Fu (JP)

( * ) Notice: Subject to any disclaimer, the term of this patent is extended or adjusted under 35 U.S.C. 154(b) by 612 days.

(21) Appl. No.: 10/972,432

(22) Filed: Oct. 26, 2004

(65) Prior Publication Data

US 2005/0095889 A1 May 5, 2005

(30) Foreign Application Priority Data

Oct. 29, 2003 (JP) ..... 2003-368282

(51) Int. Cl.
*H01R 4/60* (2006.01)

(52) U.S. Cl. ..... 439/191; 439/192; 174/47

(58) Field of Classification Search ..... 439/191–195, 439/11, 13, 22; 174/47
See application file for complete search history.

(56) References Cited

U.S. PATENT DOCUMENTS 3,866,995 A * 2/1975 Campo ..... 439/20
4,345,805 A * 8/1982 Finley et al. ..... 439/191
4,550,958 A * 11/1985 Smith ..... 439/13
4,881,909 A * 11/1989 Blackman ..... 439/191
4,894,020 A * 1/1990 Holden et al. ..... 439/191
5,109,534 A * 4/1992 Naito et al. ..... 455/66.1
6,243,915 B1 * 6/2001 Nakai et al. ..... 15/346
6,353,178 B1 * 3/2002 Linhart ..... 174/47
6,722,904 B2 * 4/2004 Linhart ..... 439/191

FOREIGN PATENT DOCUMENTS

KR 2001-0002255 1/2001

* cited by examiner

*Primary Examiner*—Renee Luebke
*Assistant Examiner*—Vanessa Girardi
(74) *Attorney, Agent, or Firm*—Antonelli, Terry, Stout & Kraus, LLP.

(57) ABSTRACT

There are provided a flexible hose 6, a connection tube 7 in which one end is connected to the inner peripheral face of the flexible hose 6 from the end 10 of the flexible hose and another end is exposed outside of the flexible hose 6, and a mold resin 24 which fixes the flexible hose 6 and the connection tube 7 by being filled over from the outer peripheral face of the flexible hose 6 nearby the end of the flexible hose 6 to the outer peripheral face of the connection tube 7 which is exposed out of the flexible hose 6.

17 Claims, 23 Drawing Sheets

360° ELECTRICAL CONTACT WITHIN A VACUUM CLEANER HOSE

BACKGROUND OF THE INVENTION

The present invention relates to a hose for vacuum cleaner. More particularly, the present invention relates to a hose for vacuum cleaner having a connection tube connected to the inner peripheral face of a flexible hose.

As the hose portion of a hose for vacuum cleaner, a flexible hose has been conventionally used considering the operability of a user. There is known a hose for vacuum cleaner which is fixed by a mold resin over the outer peripheral face of parts which is connected to a flexible hose from an outer peripheral face nearby the end face of the flexible hose, in order to improve the airtightness of the end face of the flexible hose with parts connected to the end face of the flexible hose. (For example, refer to Korean Patent Publication No. 2001-2255).

However, there have been fears that a flexible hose is deformed to an inner diameter direction by the pressure of a mold resin which is filled on the outer peripheral face of the flexible hose to damage appearance and to lower suction property. And when the flexible hose is bent, the mold resin is peeled from the flexible hose and there has been a problem in airtightness of the flexible hose with parts connected to the flexible hose.

The present invention is performed for solving such problems, and an object of the present invention is to provide a hose for vacuum cleaner which can stabilize quality and improve airtightness.

SUMMARY OF THE INVENTION

The means for solving the above-mentioned problems is characterized in being equipped with a flexible hose, a connection tube in which one end is connected to the inner peripheral face of the flexible hose from the end of the flexible hose and another end is exposed to the outside of the flexible hose, and a mold resin which fixes the flexible hose and the connection tube by being filled over from the outer peripheral face of the flexible hose nearby the end of the flexible hose to the outer peripheral face of the connection tube which is exposed out of the flexible hose.

The means for solving the above-mentioned problems is further equipped with a tubular base which is connected to the connection tube, sliding contact pieces which are provided at the outer peripheral face of the base and with which the sliding contact points of a mounted portion are electrically brought in contact in free rotation, and feed wires whose one end is electrically connected to the sliding contact pieces and another end is electrically connected to the electroconductive wires of the flexible hose, wherein one end of the feed wires is connected to the connection portion of the sliding contact pieces which are penetrated from the outer peripheral face of the base to the inner peripheral face from the inner peripheral face side of the base, and the mold resin is further filled over from the outer peripheral face of the connection tube to the inner peripheral face of the base.

The means for solving the above-mentioned problems is further equipped with a tubular ring which was formed so as to freely slide on the outer peripheral face of the connection tube, sliding contact pieces which are provided at the outer peripheral face of the ring and with which the sliding contact points of a mounted portion are electrically brought in contact in free rotation, feed wires whose one end is electrically connected to the sliding contact pieces and another end is electrically connected to the electroconductive wires of the flexible hose, and a positioning means which is formed in the connection tube and positions the ring at the fixed position of the connection tube, wherein one end of the feed wires is connected to the connection portion of the sliding contact pieces which are penetrated from the outer peripheral face of the ring to the inner peripheral face from the inner peripheral face side of the ring, and the mold resin is further filled over from the outer peripheral face of the connection tube to a gap between the outer peripheral face of the connection tube and the inner peripheral face of the ring.

The means for solving the above-mentioned problems is further equipped with a tubular slip preventive member having a concave groove which composes the portion of slip preventive mechanism with a mounted portion, a ring which was integrally formed in the connection tube and in which sliding contact pieces with which the sliding contact points of a mounted portion are electrically brought in contact in free rotation were provided at the outer peripheral face, and feed wires whose one end is electrically connected to the sliding contact piece and another end is electrically connected to the electroconductive wires of the flexible hose, wherein the slip preventive member is inserted in the ring and one end of the feed wires is connected to the connection portion of the sliding contact pieces which are penetrated from the outer peripheral face of the ring to the inner peripheral face from the inner peripheral face side of the ring, and the mold resin is further filled over from the outer peripheral face of the connection tube to a gap between the outer peripheral face of the slip preventive member and the inner peripheral face of the ring.

Further, the feed wires may be arranged so as not to be forced out in the inner peripheral face of the hose for vacuum cleaner by the penetration portion of the slip preventive member which is inserted in the ring.

Further, the feed wires are preferably covered with the mold resin.

Further, the end face of the mold resin on the outer peripheral face of the flexible hose is preferably positioned at the end of the flexible hose rather than positioned at one end of the connection tube which is connected to the inner peripheral face of the flexible hose from the end of the flexible hose.

Further, the mold resin is preferably composed of a substantially transparent material.

According to a hose for vacuum cleaner of the present invention, there are exhibited effects that the deformation of the flexible hose to an inner diameter direction by the pressure of the mold resin can be prevented by the connection tube and quality of the flexible hose can be stabilized, and it can be prevented by the connection tube to be able to improve airtightness that when the flexible hose is bent, the flexible hose is deformed to an inner diameter direction and the mold resin is peeled from the flexible hose.

In a form of the invention including a tubular base which is connected to an end of the connection tube, and sliding contact pieces provided at the outer peripheral face of the base, since the base having the sliding contact pieces is provided together with the hose for vacuum cleaner equipped with the flexible hose and connected to the connection tube, it can be prevented that the outer diameter of the hose is enlarged. Further, there are exhibited effects that the base can be fixed by the mold resin while keeping airtightness and the electric conduction portion can be insulated.

In an arrangement of the present invention having a tubular ring formed as to freely slide on the outer peripheral face of the connection tube, and sliding contact pieces provided at the outer peripheral face of the ring, there are exhibited effects that the ring can be easily fixed, therefore, assembly workability can be improved, and the electric conduction portion can be insulated.

In an arrangement of the present invention employing a tubular slip preventive member inserted in a ring which is formed integrally in the connection tube, there are exhibited effects that the connection tube which was integrally formed with the base and the slip preventive member can be fixed by the mold resin while keeping airtightness and the electric conduction portion can be insulated.

According to a further feature of the present invention, the feed wires are composed so as not to be forced out on the inner peripheral face of the hose for vacuum cleaner by the penetration portion of the slip preventive member, whereby it can be prevented that the feed wires are damaged and snapped by the mold.

According to the present invention, the feed wires are covered with the mold resin, such that the feed wires are protected by the mold resin and quality is improved.

According to an arrangement of the present invention wherein an end face of the mold resin on the outer peripheral face of the flexible hose is positioned at the end side of the flexible hose rather than positioned at one end of the connection tube which is connected to the inner peripheral face of the flexible hose from the end of the flexible hose, there are exhibited effects that even if the flexible hose is bent, it can be surely prevented by the connection tube that the mold resin is peeled from the flexible hose.

According to an arrangement of the present invention wherein the mold resin is composed of a substantially transparent material, there are exhibited effects that defects on a production process such as the connection defect of the feed wires can be confirmed from outside through the substantially transparent mold resin.

DETAILED DESCRIPTION

Embodiment 1

The hose for vacuum cleaner related to the present invention of Embodiment 1 is illustrated based on FIGS. 1 to 12.

Figure 1:
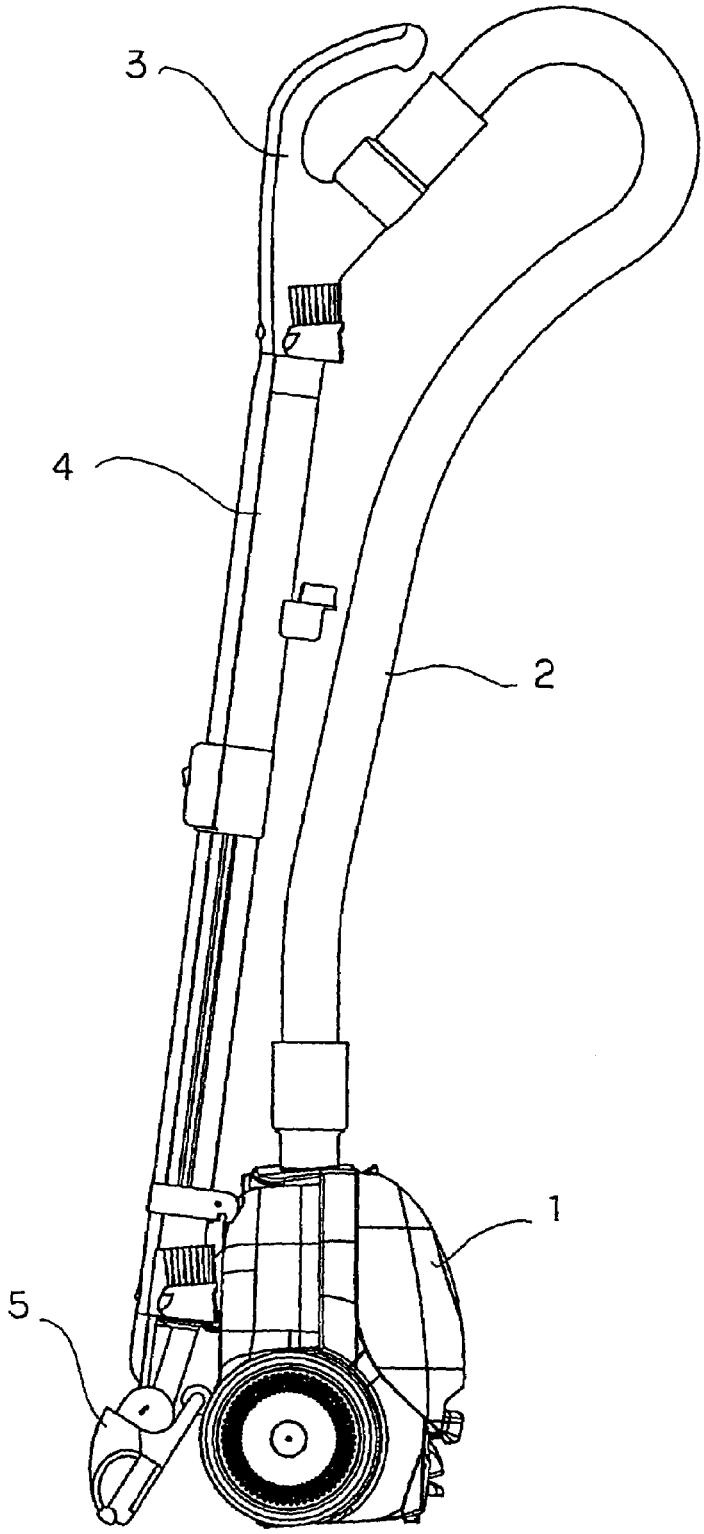
FIG. 1 is a side view of the hose for vacuum cleaner of the first mode of operation of the present invention.

The hose for vacuum cleaner of Embodiment 1 is composed of a main body of cleaner 1, a hose 2 for vacuum cleaner connected to the main body of the cleaner 1, an extension pipe 4 which is connected to the hose 2 for vacuum cleaner through a grip in hand 3, and a sniffing tool for floor 5 which is connected to the extension pipe 4 (refer to FIG. 1).

Figure 2:
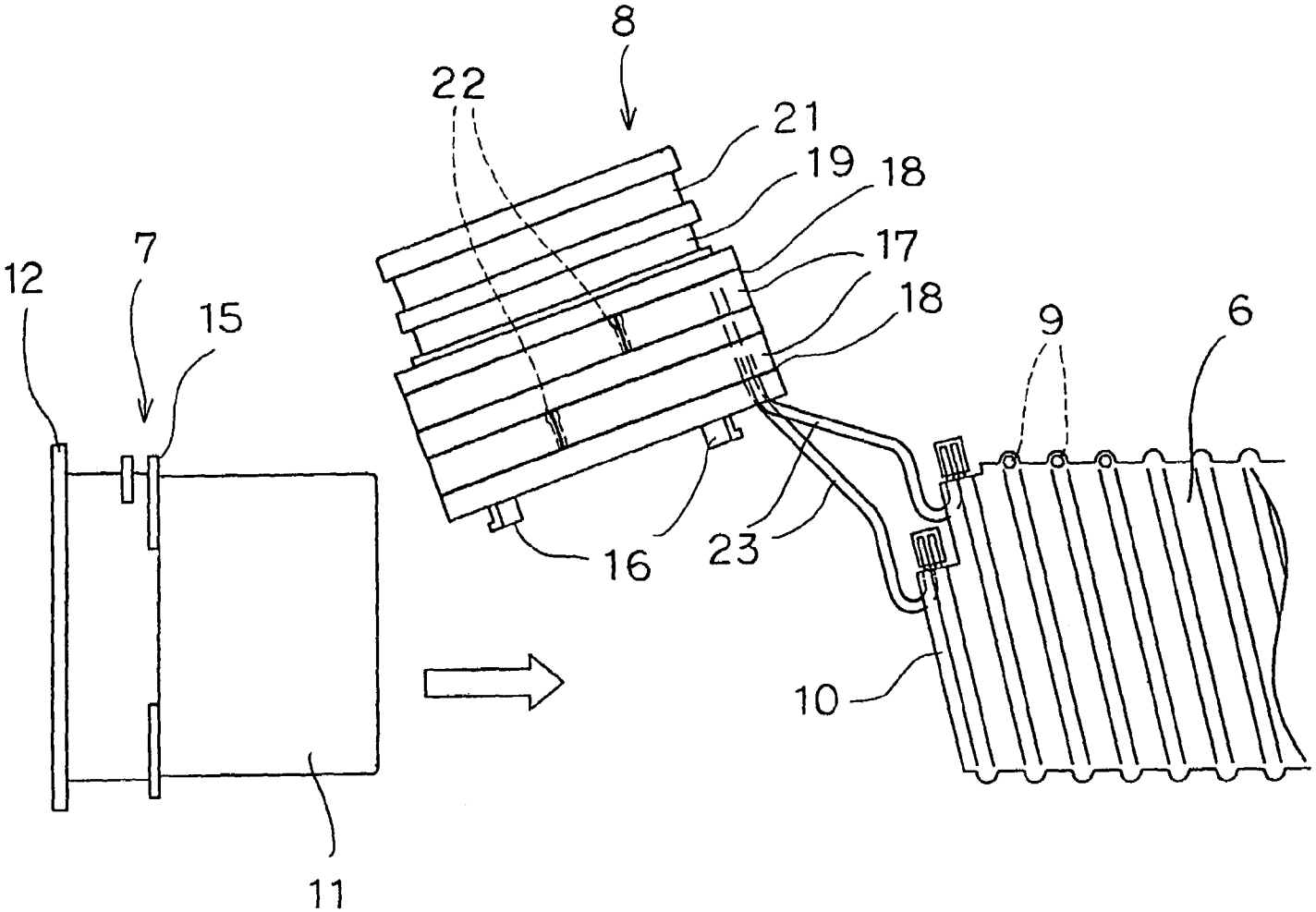
FIG. 2 is a side view of the hose for vacuum cleaner at a side connected to a grip in hand, and shows a decomposed condition.
Figure 3:
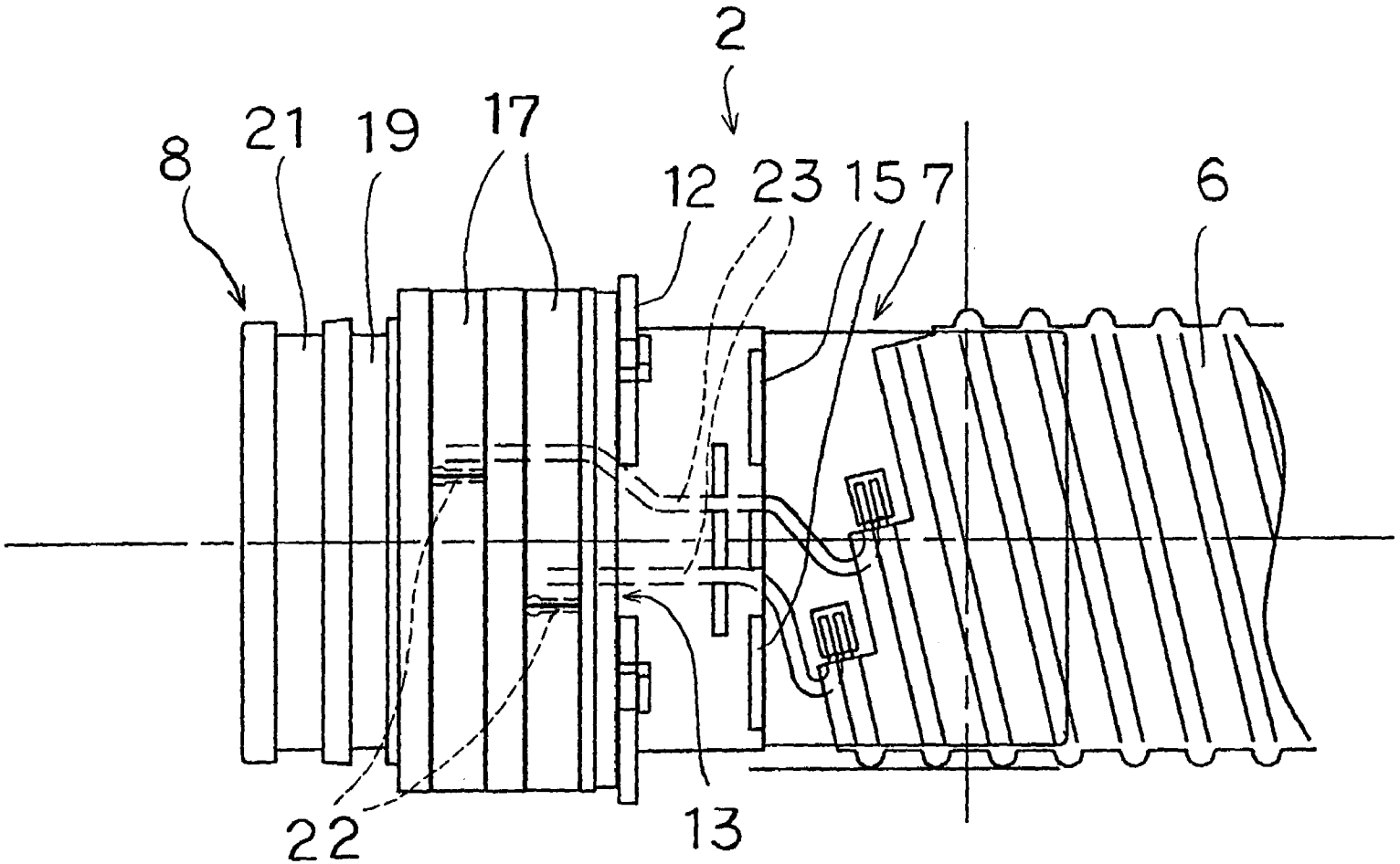
FIG. 3 is a side view of the hose for vacuum cleaner at a side connected to a grip in hand, and shows an assembled condition.
Figure 4:
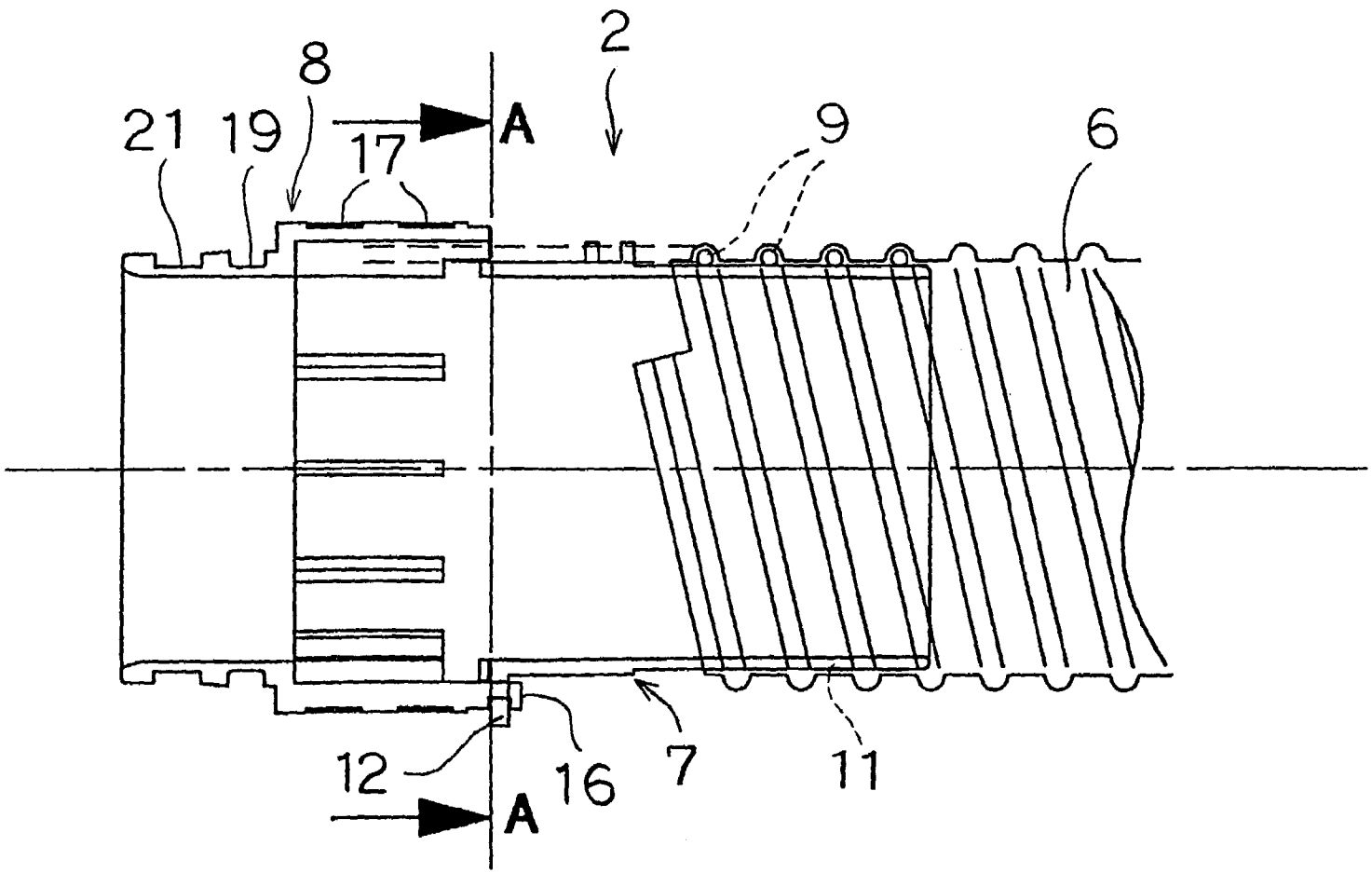
FIG. 4 is a side sectional view of the hose for vacuum cleaner at a side connected to a grip in hand, and shows an assembled condition.
Figure 5:
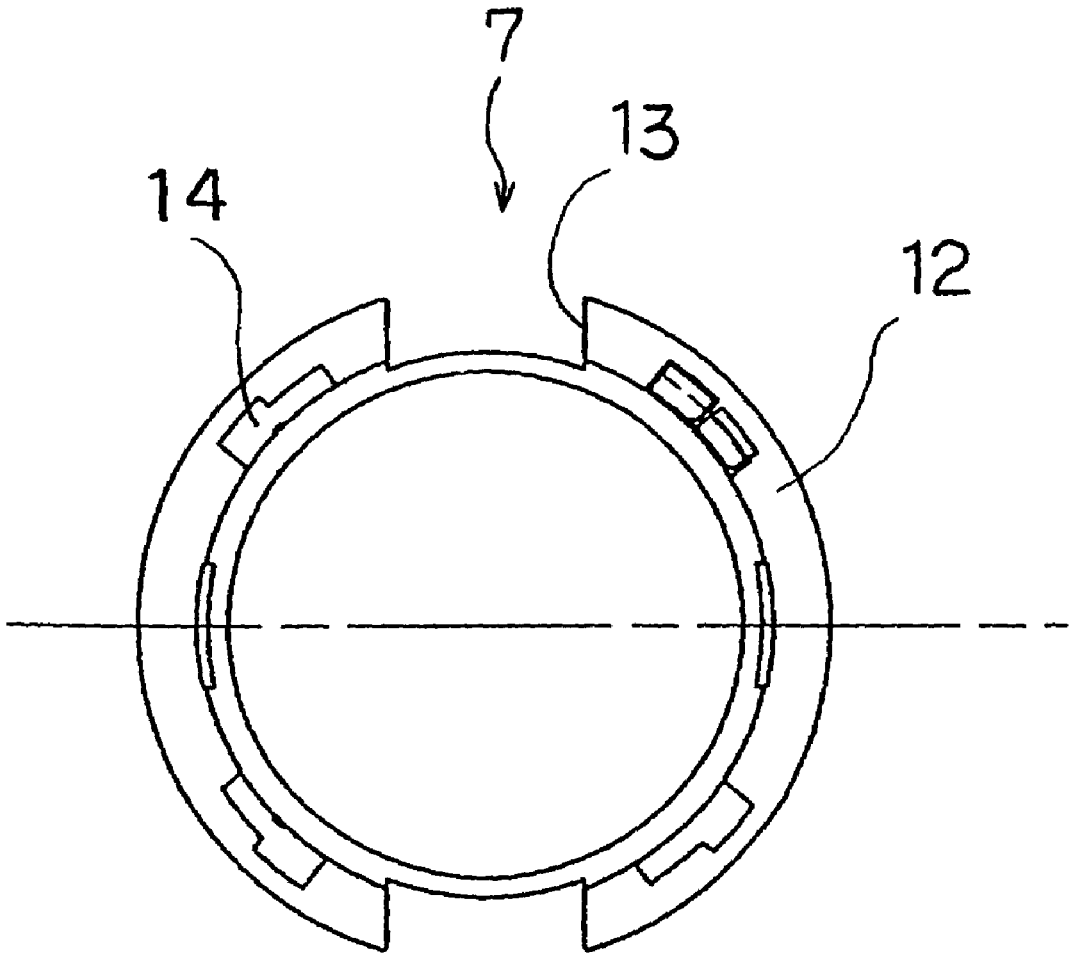
FIG. 5 is a sectional side elevation taken along A-A section of the hose for vacuum cleaner at a side connected to a grip in hand of FIG. 4.
Figure 6:
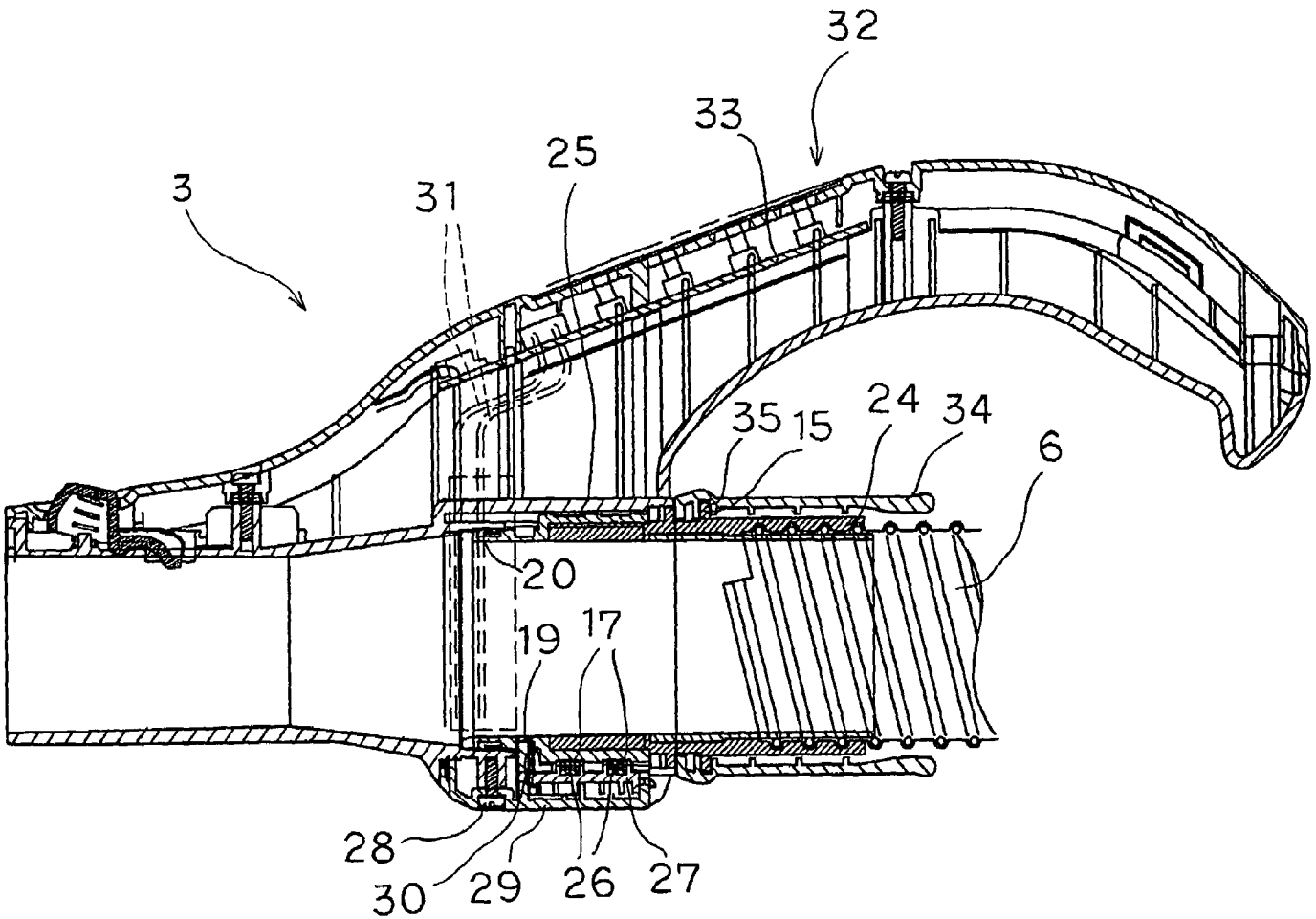
FIG. 6 is a side sectional view of a condition in which the hose for vacuum cleaner was connected to a grip in hand.
Figure 7:
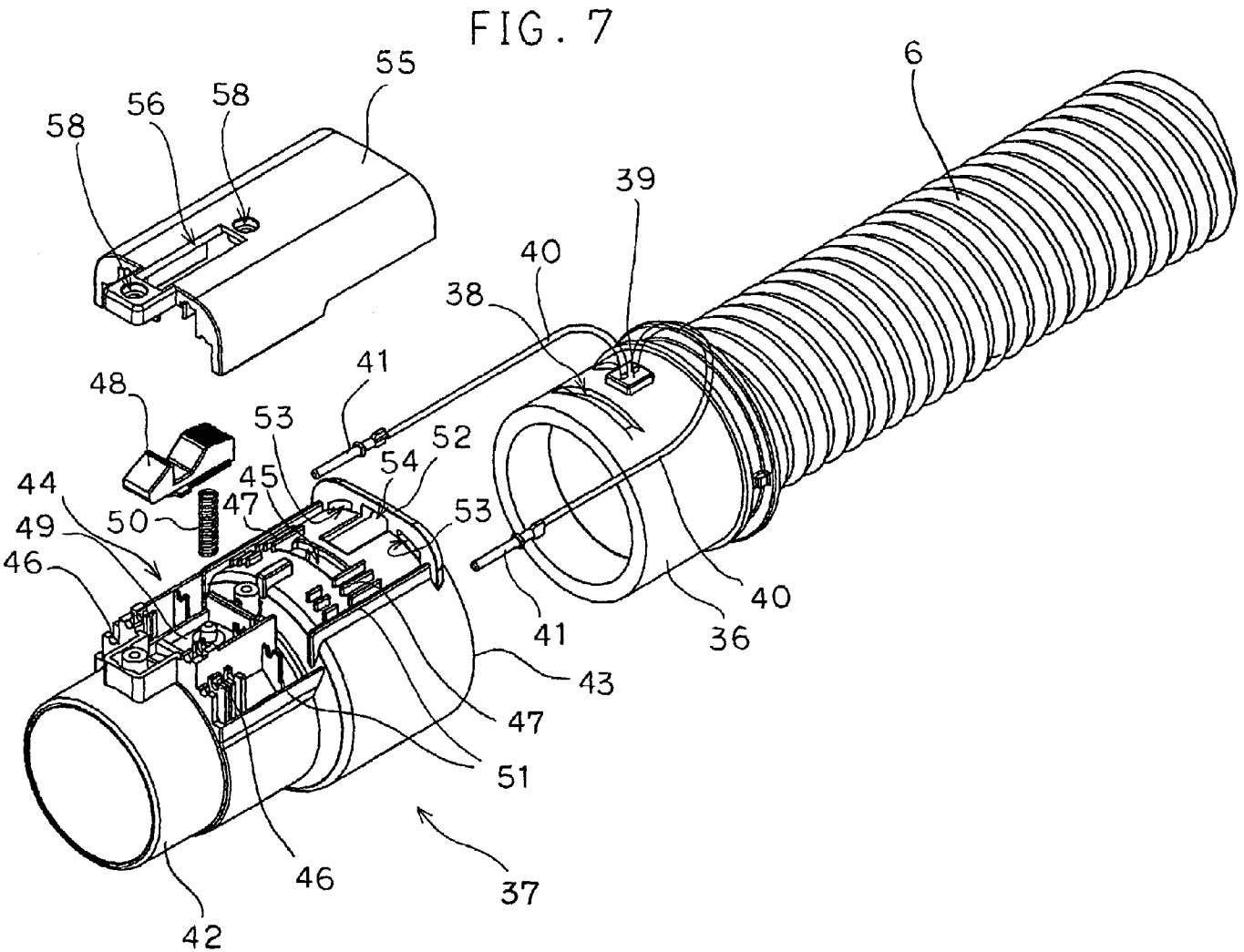
FIG. 7 is a decomposed cross perspective view of the hose for vacuum cleaner at a side connected to the main body of the vacuum cleaner.
Figure 8:
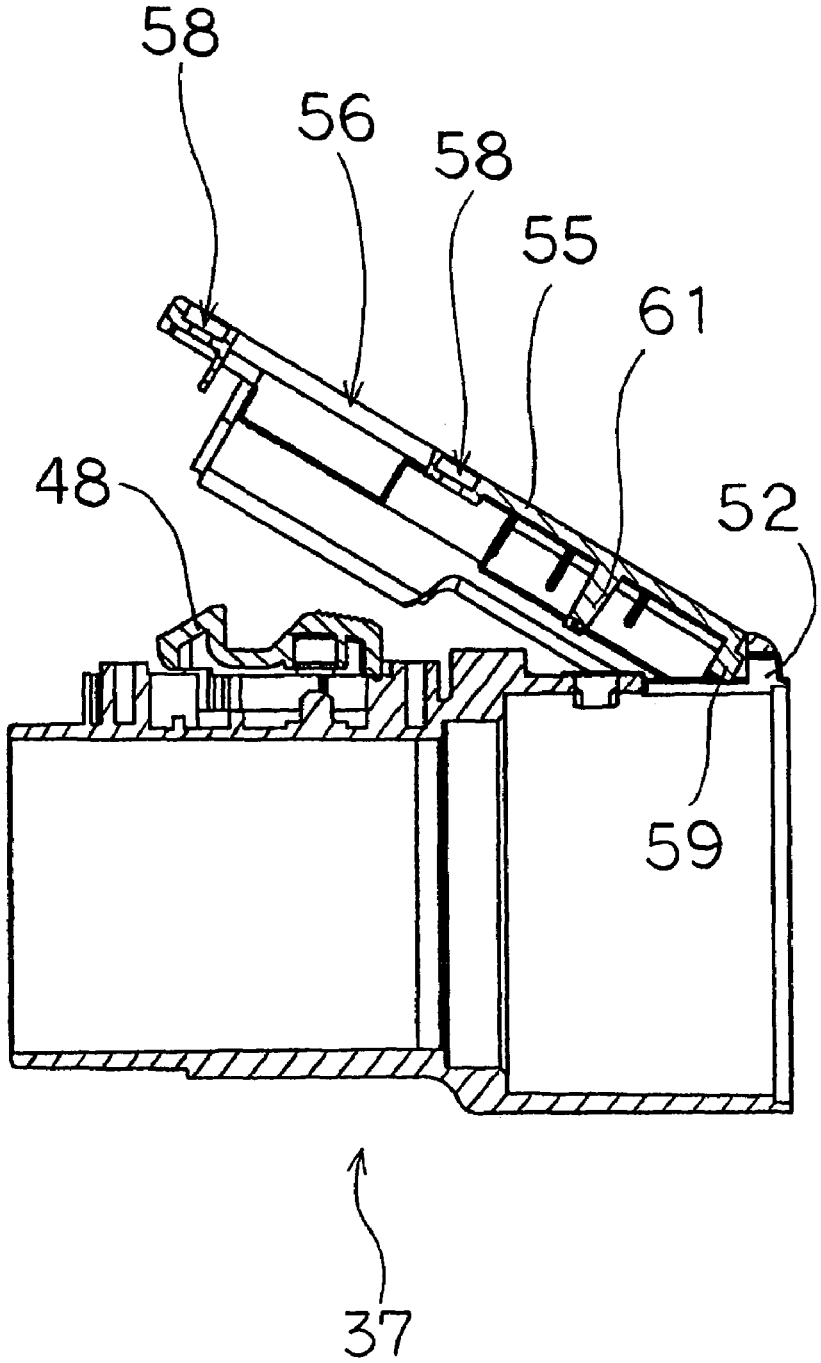
FIG. 8 is a side sectional view of the hose for vacuum cleaner at a side connected to the main body of the same cleaner, and shows the shape of the slip preventive convex portion.
Figure 9:
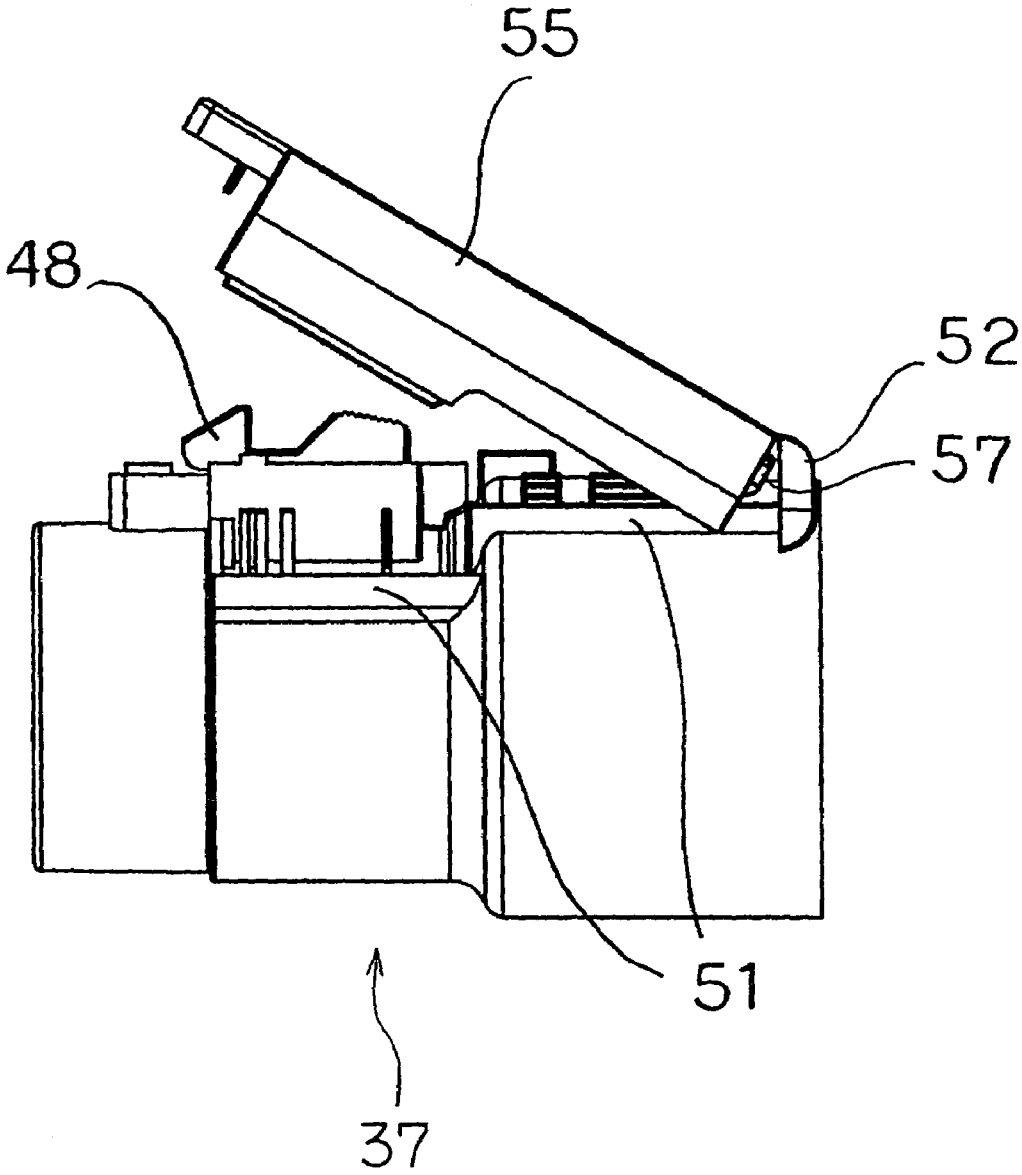
FIG. 9 is a side view of the hose for vacuum cleaner at a side connected to the main body of the same cleaner, and shows the shape of the fixation nail.
Figure 10:
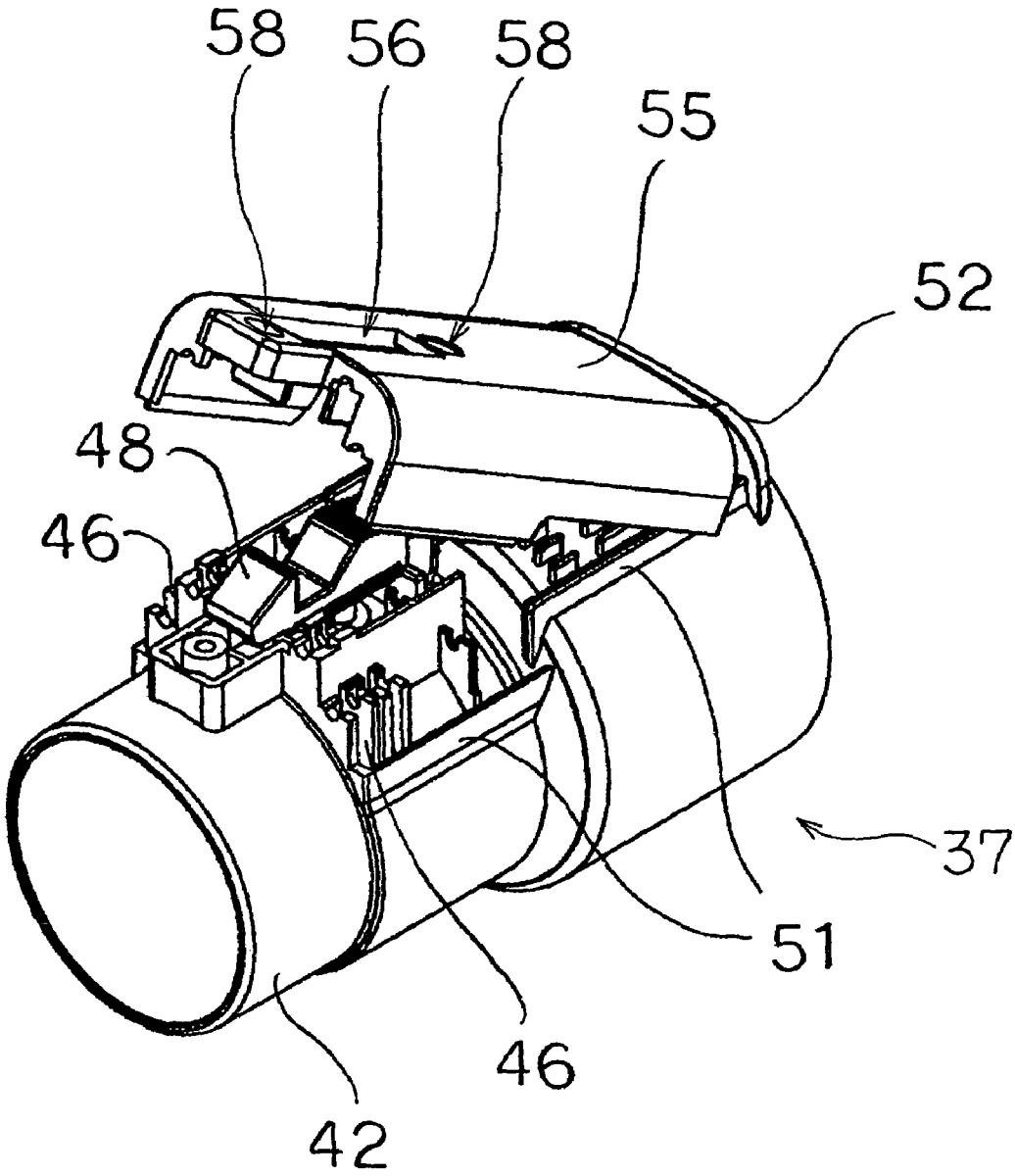
FIG. 10 is a cross perspective view of the hose for vacuum cleaner at a side connected to the main body of the same cleaner, and shows the installation condition of a cover.
Figure 11:
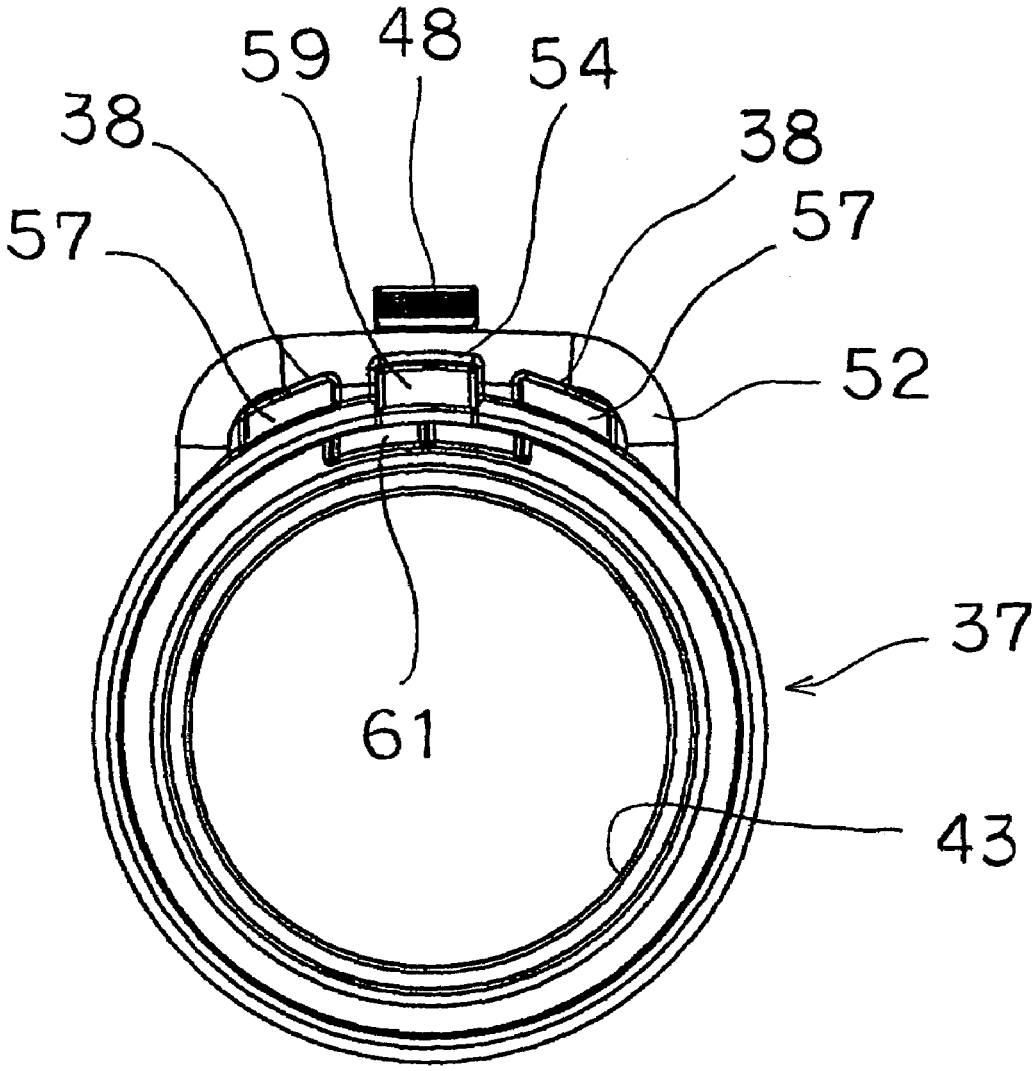
FIG. 11 is a side view of the hose for vacuum cleaner at a side connected to the main body of the same cleaner, and shows the interlocking condition of a cover.
Figure 12:
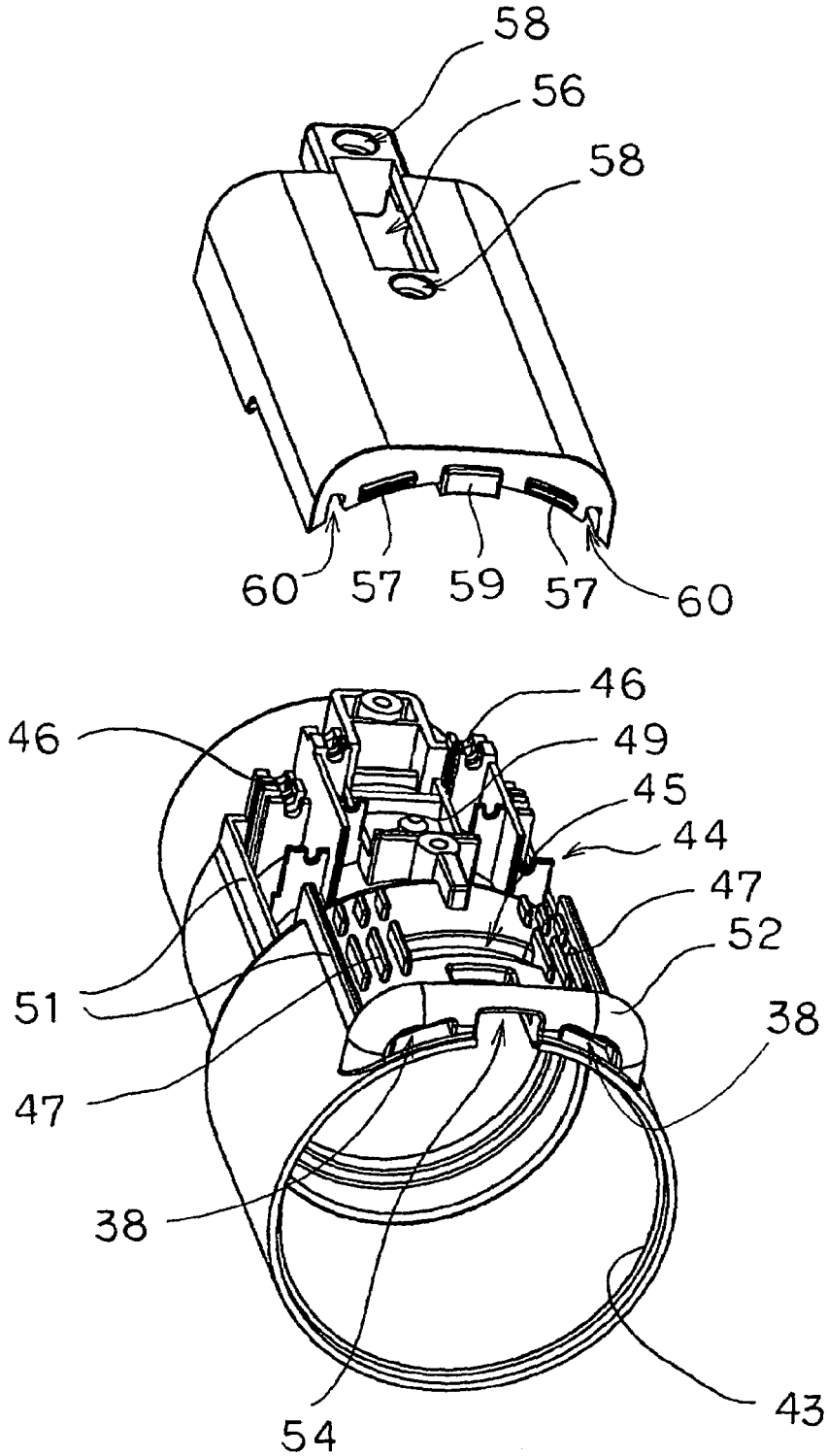
FIG. 12 is a decomposed cross perspective view of the hose for vacuum cleaner at a side connected to the main body of the same cleaner, and shows the interlocking condition of a cover.

The hose 2 for vacuum cleaner connected at a side of the grip in hand 3 is composed of a flexible hose 6, a columnar connection tube 7 whose one end is inserted into the inner peripheral face of the flexible hose 6 of the end of the flexible hose 6 to be connected, and a columnar base 8 which is connected to another end of the connection tube 7 (refer to FIGS. 2 to 4).

A pair of the electric conduction wires 9 are spirally buried in the flexible hose 6. Also, a production lot number representing production date is printed nearby an end 10 of the flexible hose. A columnar insertion portion 11 which is inserted into the inner peripheral face of the flexible hose 6 is formed at one end side of the connection tube 7, and a substantially disc flange 12 is formed at another end. A pair of notched portions 13 are formed at mutually facing position of the flange 12, and the interlocking holes 14 are formed at four spots at an equal distance on the same circumference. Protrusion portions 15 which are protruded to outside from the outer peripheral face are formed between the flange 12 of the connection tube 7 and the insertion portion 11.

A pair of the interlocking nails 16 which are interlocked with interlocking holes 14 which were formed on the flange 12 of the connection tube 7 are formed at the one end of the base 8. Further, a pair of sliding grooves 18 for mounting a pair of the rectangular sliding pieces 17 are formed at the outer peripheral face of the base adjacent to the interlocking nails 16, and the concave groove 19 which is interlocked with the grip in hand 3 and the seal groove 21 for mounting the packing 20 are provided in parallel. The penetration holes 22 which link the inner peripheral face of the base 8 and the outer peripheral face are respectively formed at the pair of sliding grooves 18 (refer to FIGS. 2 to 5).

The assembly method of the hose 2 for vacuum cleaner at a side connected to the grip in hand is illustrated.

After one end of the sliding pieces 17 are inserted into penetration holes 22 from the outer peripheral face of the base 8 and exposed to the inner peripheral face, the sliding pieces 17 are provided to the outer peripheral face along the sliding grooves 18, and another end of the sliding pieces 17 are exposed to the inner peripheral face of the base 8 through the penetration holes 22 as same as one end of the sliding pieces 17. One end of feed wires 23 are inserted into the inner peripheral face of the base 8 from the interlocking nails 16 side and electrically connected to the sliding pieces 17 which were exposed on the inner peripheral face of the base 8, and another end of the feed wires 23 are electrically connected to the electric conduction wires 9 of the flexible hose 6.

The insertion portion 11 of the connection tube 7 is inserted in the inner peripheral face of the flexible hose 6 from the end 10 of the flexible hose and the connection tube 7 is mounted with the flexible hose 6. Then, the interlocking nails 16 of the base 8 are interlocked with the interlocking holes 14 of the connection tube 7 and the base 8 is mounted with the connection tube 7. At this time, the feed wires 23 are wired so as to run through the notched portions 13 (refer to FIGS. 2 to 5).

In a condition in which the connection tube 7 and the base 8 are mounted with the flexible hose 6, the base 8 and the connection tube 7 and the outer peripheral face of the flexible hose 6 are set in a mold which is not shown in Figures, in a form of supporting the outer peripheral face, and the substantially transparent mold resin 24 is filled in the mold. The mold resin 24 is filled from the outer peripheral face nearby the end 10 of the flexible hose over the outer peripheral face of the connection tube 7, and filled from the outer peripheral face of the connection tube 7 through the notched portions 13 of the flange 12 over the inner peripheral face of the base 8 which corresponds to the sliding pieces 17 of the base 8. Further, the end face of the mold resin 24 on the outer peripheral face of the flexible hose 6 is formed so as to be positioned at the end 10 of the flexible hose rather than positioned at the end of the insertion portion 11 of the connection tube 7 (refer to FIG. 6).

Since the flexible hose 6 is filled with the mold resin 24 after the connection tube 7 was inserted in the inner peripheral face, it is possible to prevent the deformation to an inner diameter direction of the flexible hose 6 caused by the pressure of the mold resin 24 through the connection tube 7. As a result, the quality of the hose 2 for vacuum cleaner can be stabilized (refer to FIG. 6).

Further, when the flexible hose 6 is bent, it can be prevented by the connection tube 7 that the flexible hose 6 is deformed to an inner diameter direction and the mold resin 24 is peeled from the flexible hose 6. As a result, the airtightness of the hose 2 for vacuum cleaner can be improved. Further, since the end face of the mold resin 24 on the outer peripheral face of the flexible hose 6 is formed so as to be positioned at the end 10 of the flexible hose than the edge of the insertion portion 11 of the connection tube 7, it can be surely prevented that when the flexible hose 6 is bent, the flexible hose 6 nearby the end face of the mold resin 24 is crushed and the mold resin 24 is peeled (refer to FIG. 6).

After being electrically connected the sliding pieces 17 mounted on the base 8 with the electric conduction wires 9 of the flexible hose 6 by the feed wires 23 preliminarily, the base 8 is connected to the flexible hose 6 through the connection tube 7, therefore the length of the feed wires 23 can be shortened, and the assembly workability of the hose 2 for vacuum cleaner can be improved.

Since the feed wires 23 are covered with the mold resin 24, external force is not applied to the feed wires 23 and the feed wires 23 can be protected.

Although the electric connection portion of one end of the feed wires 23 with the electric conduction wires 9 and the electric connection portion of another end of the feed wires 23 with the sliding pieces 17 are the electric conduction portions together, no problem occurs in insulation because the electric conduction portions at two spots are covered with the mold resin 24. Further, since the inner peripheral face of the base 8 is filled with the mold resin 24, the sliding pieces 17 can be fixed on the base 8 by fixing both ends of the sliding pieces 17 which are exposed in the inner peripheral face of the base 8 with the mold resin 24.

Since the mold resin 24 is composed of a substantially transparent material, the production lot number printed nearby the end 10 of the flexible hose can be confirmed from outside, and the connection defects of the feed wires 23 can be easily confirmed from outside.

Since the base 8 having the sliding pieces 17 can be provided together with the flexible hose 6 through the connection tube 7, the outer diameter of the hose 2 for vacuum cleaner can be reduced.

The end of the hose 2 for vacuum cleaner at a side connected to the grip in hand 3 is inserted into a column portion 25 of the grip in hand 3. A sliding portion 27 having a sliding contact point 26 which is electrically brought in contact with the sliding pieces 17 is mounted by the lid body 29 which is fixed on the columnar portion 25 of the grip in hand 3 by screws 28. A protrusion 30 which is inserted into the concave grooves 19 of the connection tube 7 is formed at the lid body 29, and the slip of the hose 2 for vacuum cleaner from the grip in hand 3 is prevented by the protrusion portion 30. A packing 20 is mounted on a seal groove 21, and the airtightness of the hose 2 for vacuum cleaner with the columnar portion 25 of the grip in hand 3 is retained (refer to FIG. 6).

A sliding contact point 26 is electrically connected to a substrate 33 of an operational portion 32 of the grip in hand 3 by the connection wires 31. The grip in hand 3 is freely rotated by 360° left and right to a peripheral direction against the hose 2 for vacuum cleaner. Even if the grip in hand 3 moves in rotation, the sliding contact point 26 is always electrically brought in contact with the sliding pieces 17. A pair of covers 34 are mounted so as to cover around the end 10 of the flexible hose in adjacent position to the columnar portion 25 of the grip in hand 3. Groove portions 35 are formed on a covers 34, and the covers 34 are interlocked by interlocking the protrusion portion 15 with the groove portions. When the covers 34 are removed, the production lot number printed nearby the end 10 of the flexible hose can be easily confirmed from outside through the substantially transparent mold resin 24 (refer to FIG. 6).

The hose 2 for vacuum cleaner which is connected to the main body of the cleaner 1 is composed of the flexible hose 6, connection portion 36 which is connected to the end of flexible hose 6, and the hose connection portion 37 at the main body whose one end is connected to the main body of the cleaner 1 and another end is connected to the connection portion 36.

A slip preventive hole 38 for preventing the slip of the hose 2 for vacuum cleaner is formed in the connection portion 36. Further, a terminal 39 is formed on the connection portion 36, the lead wires 40 which are electrically connected to the electric conduction wires 9 of the flexible hose 6 are extendedly provided outside of the connection portion 36 through the terminal 39. The connection terminals 41 which are electrically connected to the main body of the cleaner 1 are connected at the end of the lead wires 40. The outer peripheral face of a range from nearby the end of the flexible hose 6 to the terminal 39 is covered with the mold resin not shown in Figures (refer to FIG. 7).

The hose connection portion 37 at the main body forms an insert portion 42 which is connected to the main body of the vacuum cleaner 1 at one end side, and an inserted portion 43 in which the connection portion is inserted at another side. A storage 44 is formed at the outer peripheral face of the hose connection portion 37 at the main body. An open work hole 45 which corresponds to the slip preventive hole 38 of the connection portion 36, a connection terminal retaining portion 46 which retains the connection terminals 41, a lead wire processing portions 47 for wiring the lead wires 40, and a clump hook retaining portion 49 for retaining a clump hook 48 which is interlocked with the main body of the vacuum cleaner 1 is formed in the storage 44. The clump hook 48 is energized by a spring 50 to a direction to which the clump hook 48 is interlocked with the main body of the cleaner 1. A guide rib 51 is formed at the outer block of the storage 44, and an insert wall 52 is formed at the side of inserted portion 43. Interlocking holes 53 are formed on the insert wall 52, and an escape portion 54 is formed in which the terminal 39 and the lead wires 40 are inserted when the connection portion 36 is connected to the hose connection portion 37 at the main body (refer to FIG. 7).

The storage 44 is blocked by a cover 55 which is positioned by the guide ribs 51 and the insert wall 52 of the storage 44. At the cover 55, there are formed an insertion portion 56 in which the clump hook 48 for exposing the clump hook 48 is inserted, a hooking nail 57 which is inserted in the hooking holes 53 which is formed in the hose connection portion 37 at the main body and hooks one end of the cover 55, a screw hole 58 for screwing another end of the cover 55, the blindfold portion for blindfolding the escape portion 54, a lead wire insertion holes 60 in which the lead wires 40 are inserted, and a slip preventive convex portion 61 which is inserted in the slip preventive hole 38 through the open work hole 45. When the slip preventive convex portion 61 is inserted in the slip preventive hole 38 through the open work hole 45, the slip of the hose connection portion at the main body side is prevented against the connection portion 36, and when both ends of the slip preventive convex portion 61 are brought in contact with the both ends of the slip preventive hole 38, the hose connection portion 37 at the main body is stopped to rotate against the connection portion 36 (refer to FIGS. 7 to 12).

Since the mold resin which fixes the flexible hose 6 and the connection portion 36 is inserted and hidden into the hose connection portion 37 at the main body, appearance can be improved without increasing the number of parts. Further, respective parts are stored in the storage 44, and the hose 2 for vacuum cleaner which is connected to the main body of the cleaner 1 can be assembled only by blocking the storage 44 with the cover 55, therefore the composition can be simplified and assemble workability can be improved. Further, since the cover 55 can be positioned by the guide ribs 51 and the insert wall 52, assemble workability can be further improved.

Through connecting the hose 2 for vacuum cleaner to the grip in hand 3 and the main body of the cleaner 1, the main body of the cleaner 1 is electrically connected to the substrate 33 of the grip in hand 3 through the electric conduction wire 9 of the flexible hose 6.

Embodiment 2

Figure 13:
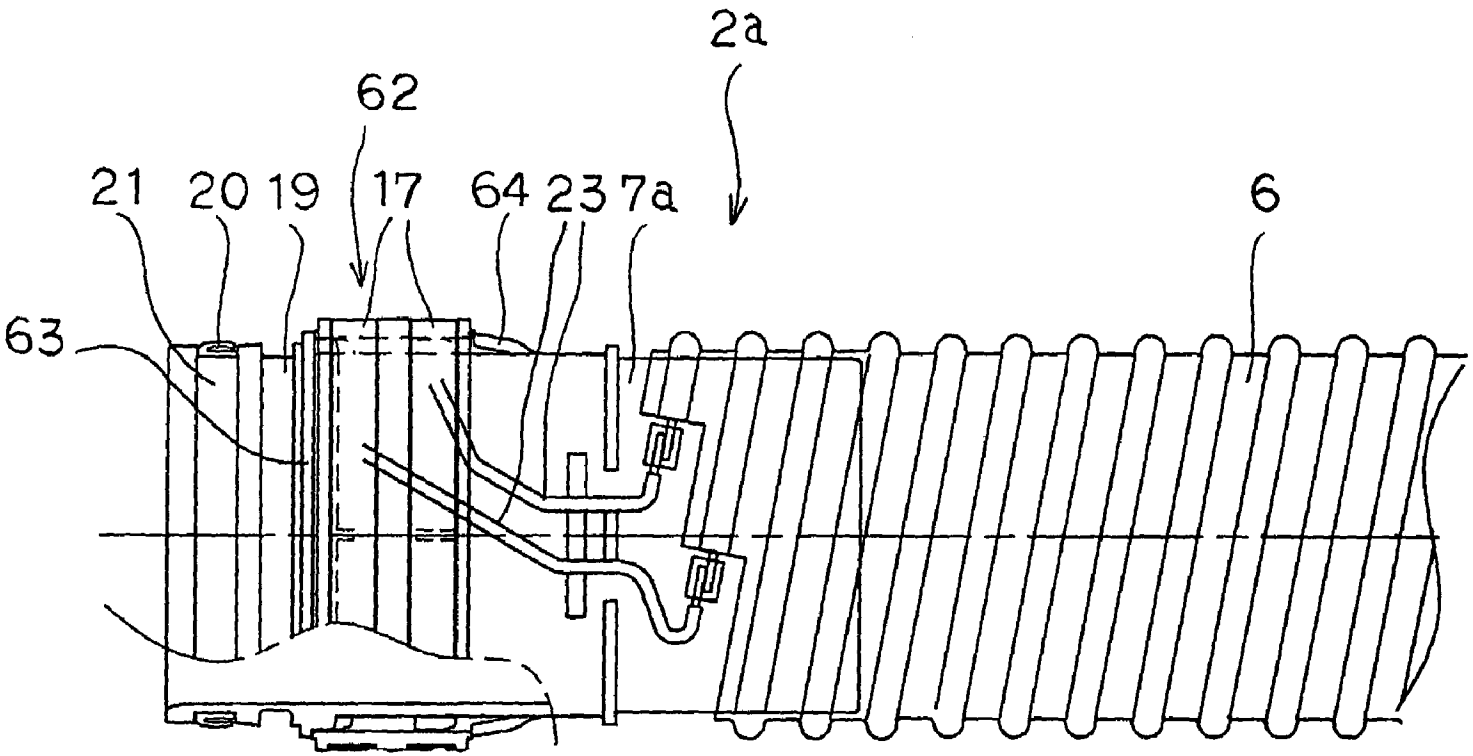
FIG. 13 is a side view of the hose for vacuum cleaner at a side connected to a grip in hand of the vacuum cleaner of the second mode of operation of the present invention.
Figure 14:
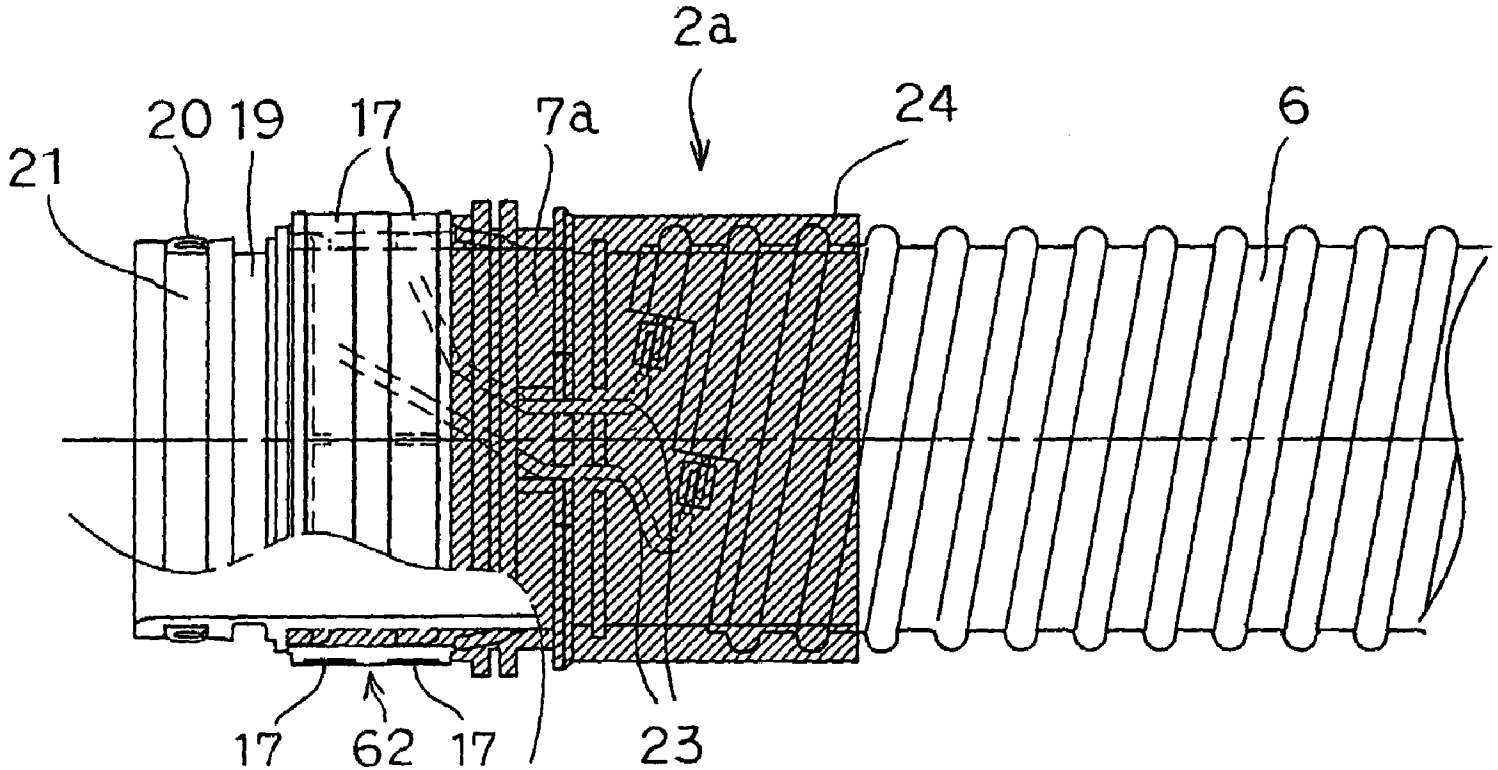
FIG. 14 is a side view of the hose for vacuum cleaner at a side connected to the same grip in hand, and shows a condition in which a mold resin was filled.
Figure 15:
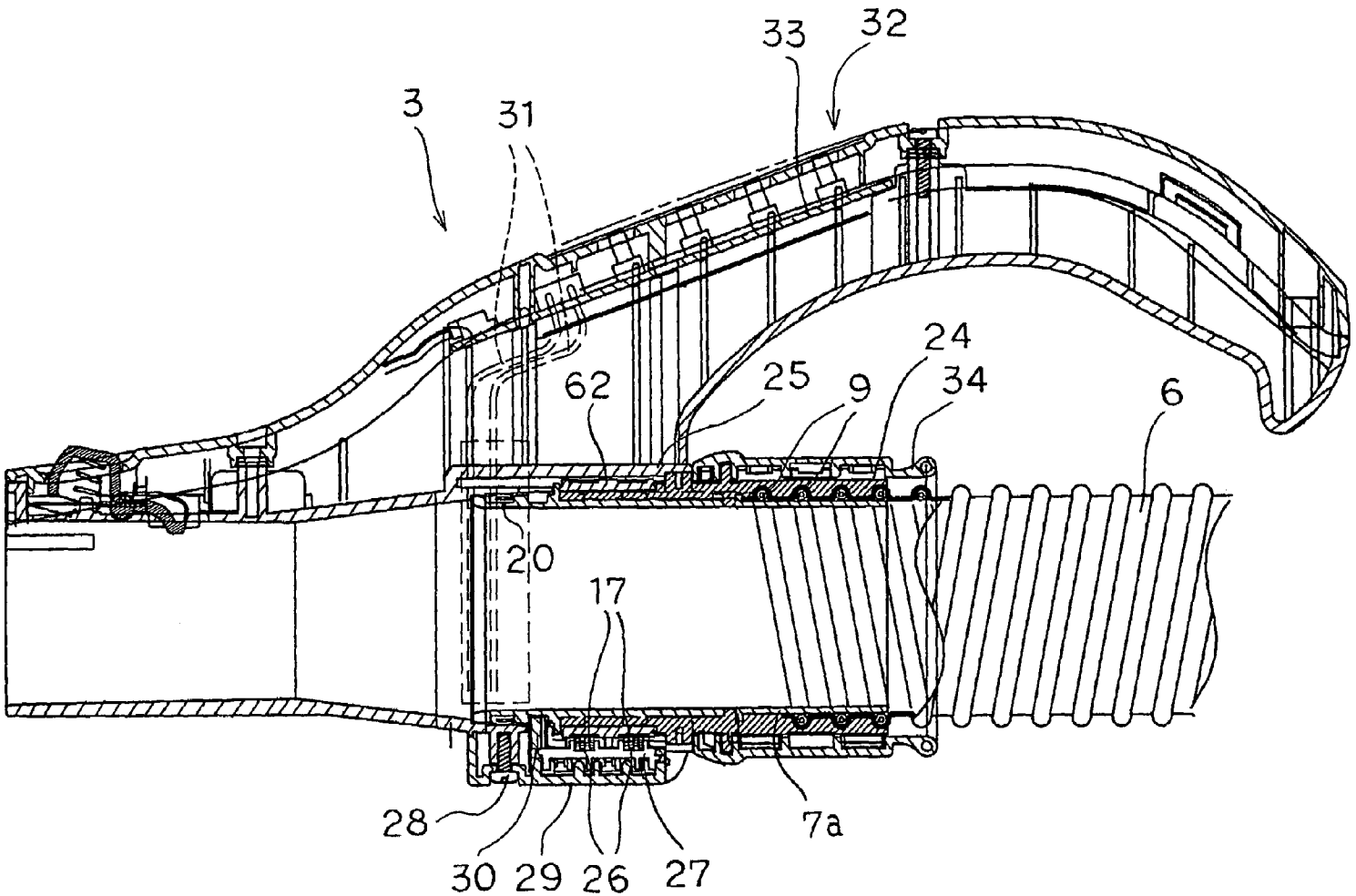
FIG. 15 is a side sectional view of a condition in which the hose for vacuum cleaner was connected to the grip in hand.
Figure 16:
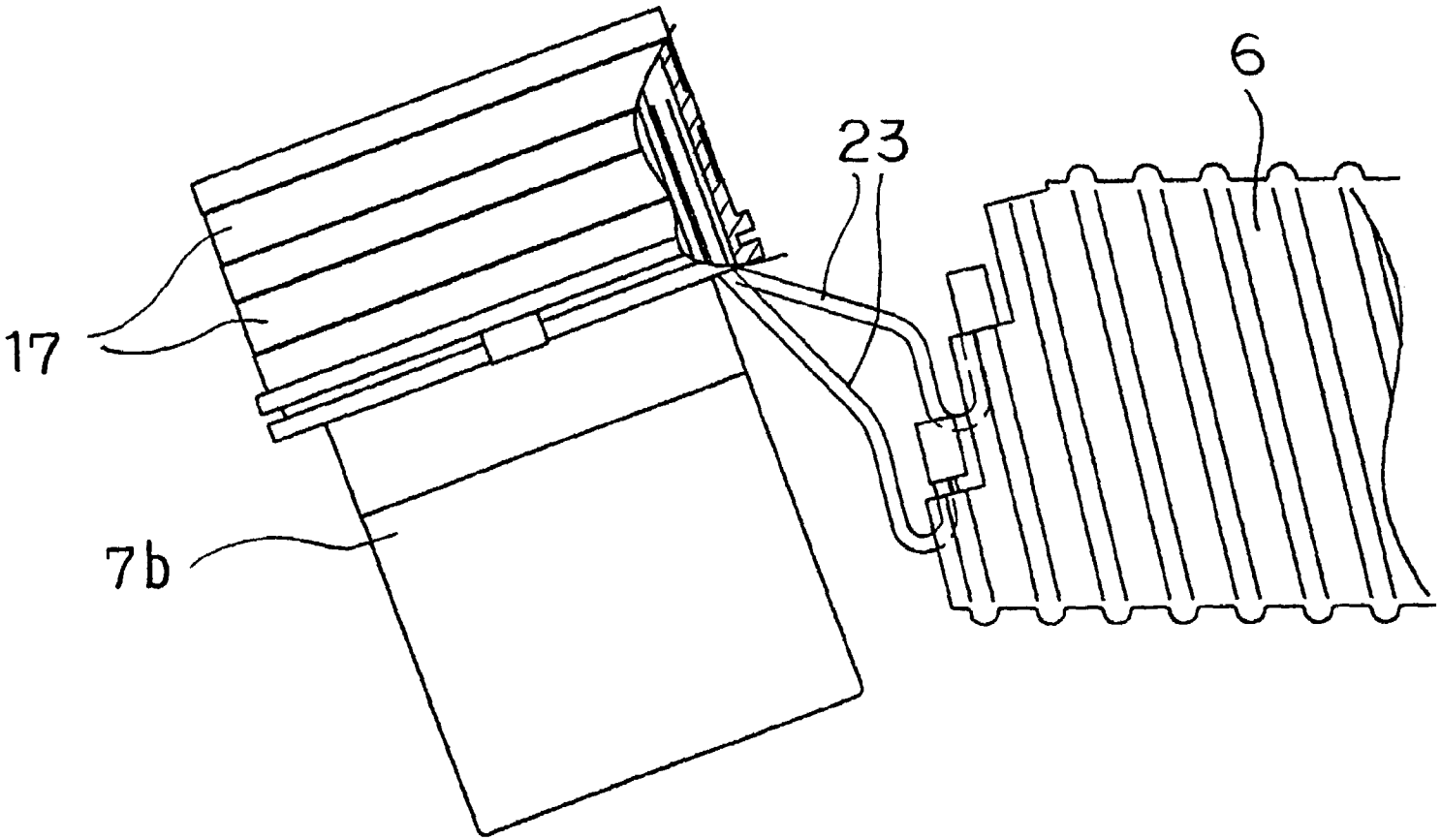
FIG. 16 is a side view of the hose for vacuum cleaner at a side connected to a grip in hand of the vacuum cleaner of the third mode of operation of the present invention, and shows a condition in which a flexible hose was electrically connected to a connection tube.
Figure 17:
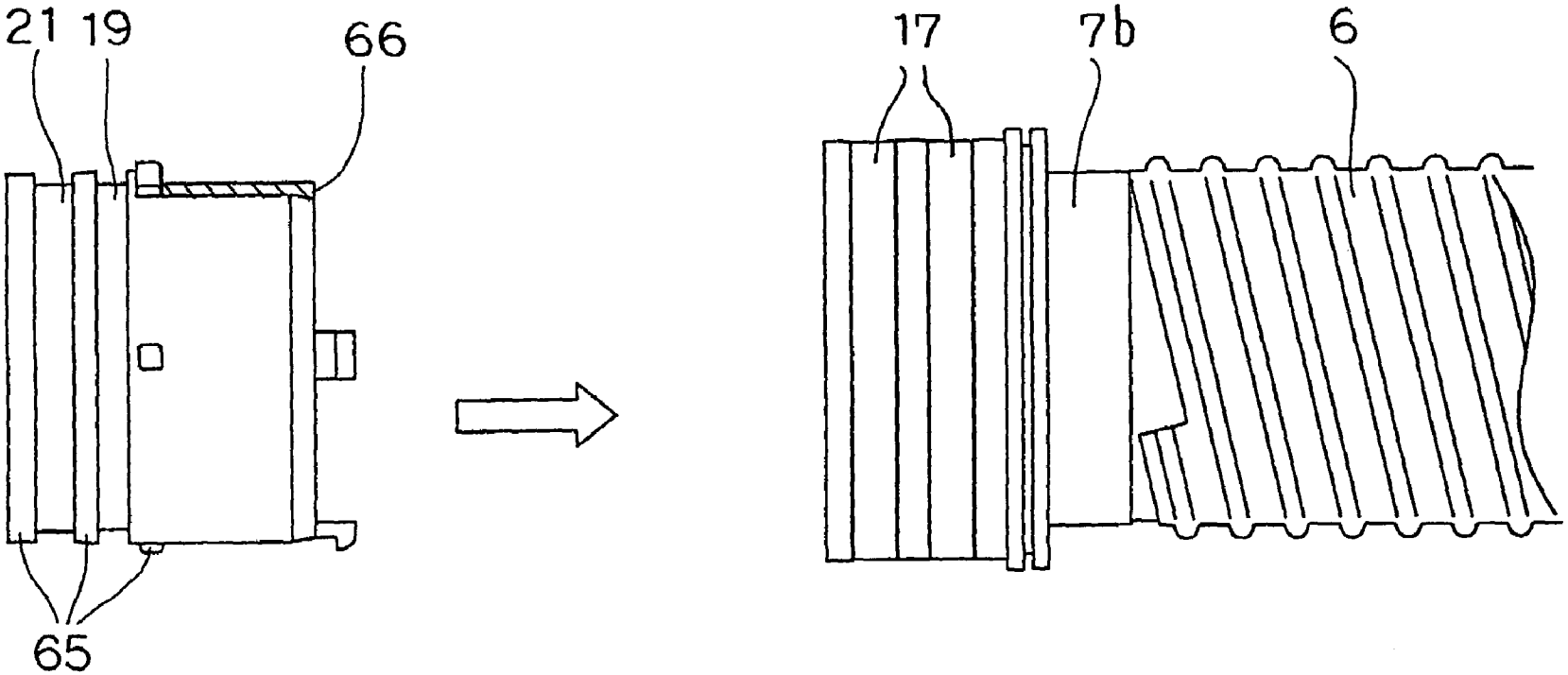
FIG. 17 is a side view of the hose for vacuum cleaner at a side connected to the same grip in hand, and shows a condition in which a slip preventive portion is connected to a connection tube.
Figure 18:
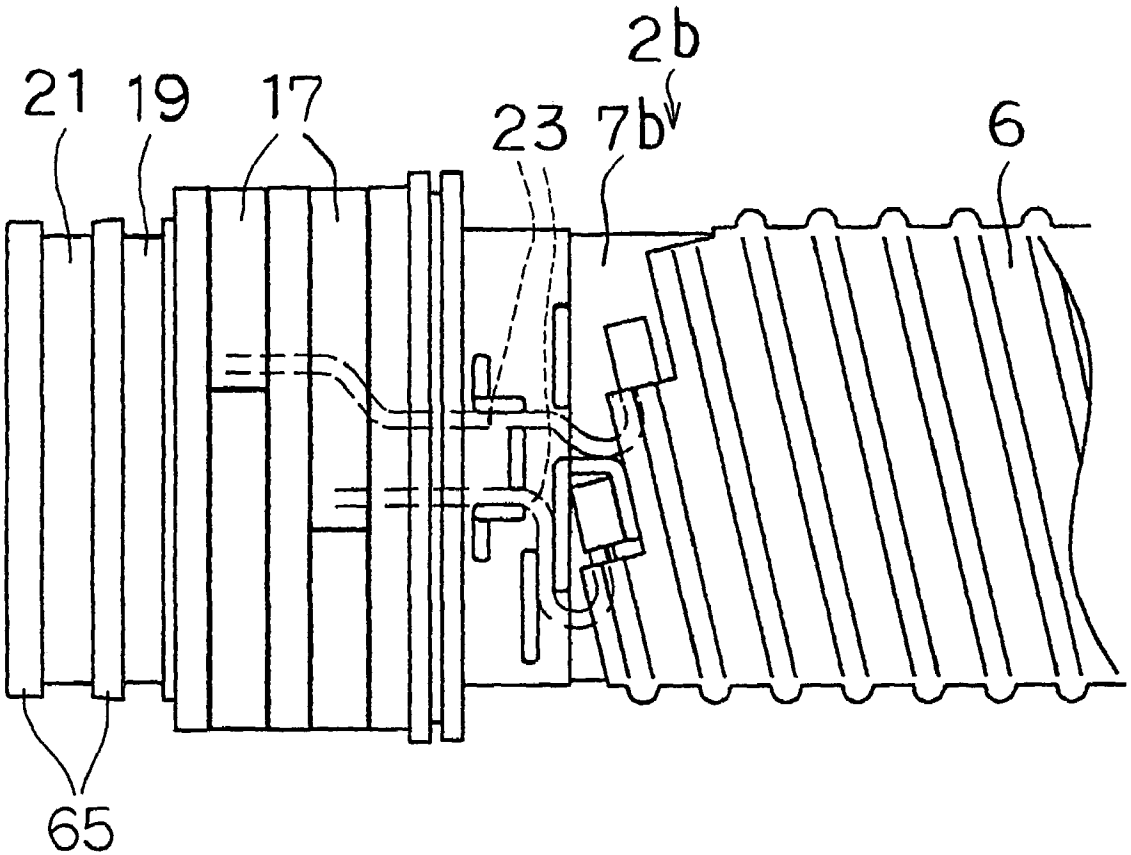
FIG. 18 is a side view of the hose for vacuum cleaner at a side connected to the same grip in hand, and shows an assembled condition.
Figure 19:
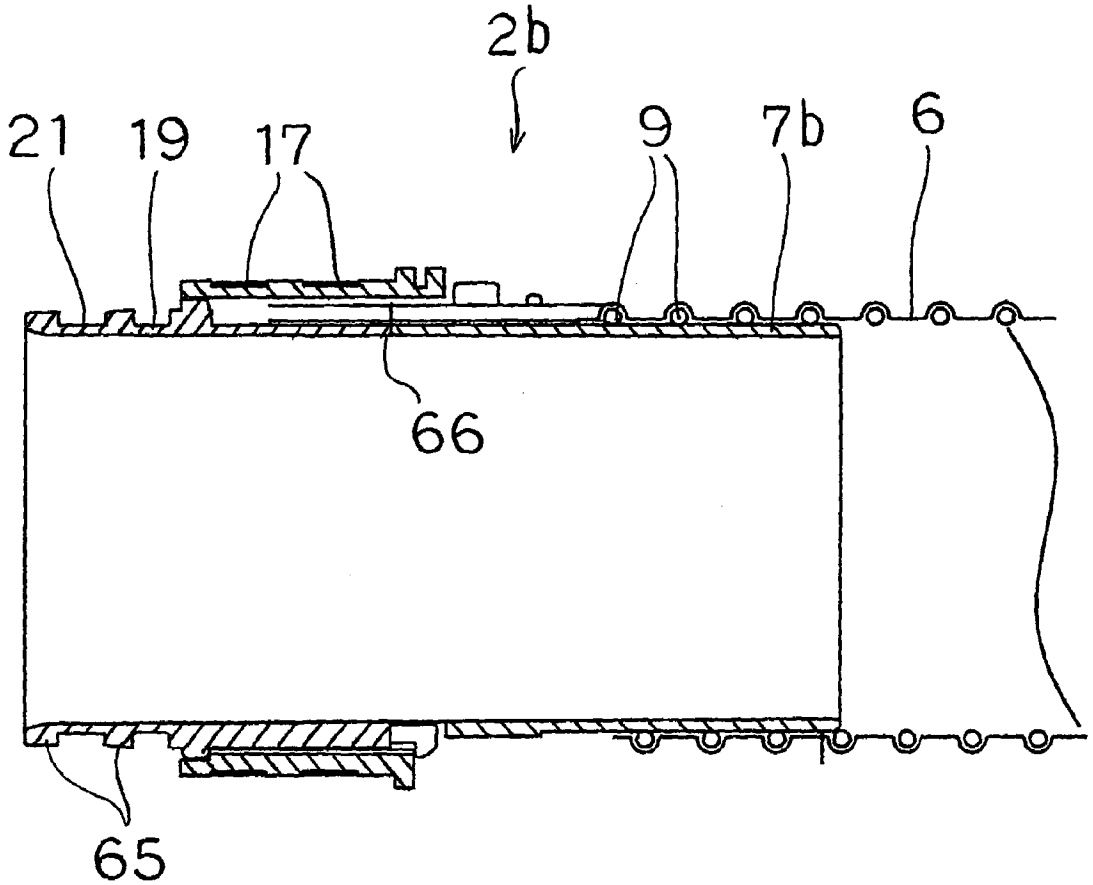
FIG. 19 is a side sectional view of a condition in which the hose for vacuum cleaner at a side connected to the same grip in hand was assembled.

FIGS. 13 to 15 show the Embodiment 2 of the present invention. The same numerals are provided for the same numerals as Embodiment 1, and illustration is abbreviated.

The Embodiment 2 is different with respect to an arrangement of the hose 2*a* for vacuum cleaner which is connected to the grip in hand 3 compared with the arrangement in Embodiment 1. The connection tube 7*a* forms integrally the slip preventive portion having the seal groove 21 of the base 8 and the concave groove 19 in Embodiment 1, a ring 62 having the sliding pieces 17 of the base 8 in Embodiment 1 is formed on the outer peripheral face of the connection tube 7*a* in free sliding. At the connection tube 7*a*, there are formed a stopper 63 which stops the movement of the ring 62 to an insertion direction, and a temporary fixation portion 64 for temporarily fixing the ring 62 at a side facing the stopper 63. The temporary fixation portion 64 is usually protruded to an outer peripheral direction (refer to FIG. 13).

As same as Embodiment 1, the sliding pieces 17 of the ring 62 are electrically connected to the electric conduction wires 9 of the flexible hose 6 through the feed wires 23. The ring 62 is inserted into the outer peripheral face of the connection tube 7*a* from a side which is connected to the flexible hose 6 of the connection tube 7*a*, and the connection tube 7*a* is inserted in the inner peripheral face of the flexible hose 6. Then, when the ring 62 is slid along the outer peripheral face of the connection tube 7*a*, the temporary fixation portion 64 is deformed to the inner peripheral direction by the inner peripheral face of the ring 62, and when the ring 62 goes over the temporary fixation portion 64, the ring 62 is brought in contact with the stopper 63 which is formed on the connection tube 7*a* and the slide to an insertion direction is blocked. The temporary fixation portion 64 is deformed to the outer peripheral direction, and the slide of the ring 62 to a direction to which the ring 62 was inserted is blocked by the temporary fixation portion 64. Thus, the ring 62 is temporarily fixed (refer to FIG. 13).

As same as Embodiment 1, the airtightness of the flexible hose 6 and the connection tube 7*a* is maintained and can be fixed by filling the mold resin 24 between the flexible hose 6 and the connection tube 7*a*. Further, the ring 62 can be fixed by filling the mold resin 24 in a gap between the inner peripheral face of the ring 62 and the outer peripheral face of the connection tube 7*a* (refer to FIGS. 14 and 15).

In the arrangement according to Embodiment 2, after the sliding pieces 17 are electrically connected to the electric conduction wires 9 of the flexible hose 6 by the feed wires 23 preliminarily, the ring 62 is inserted into the outer peripheral face of the connection tube 7*a*; therefore the length of the feed wires 23 can be shortened, and the assembly workability of the hose 2*a* for vacuum cleaner can be improved.

Since the feed wires 23 are covered with the mold resin 24, external force is not applied to the feed wires 23, and the feed wires 23 can be protected.

Although the electric connection portion of the feed wires 23 and the electric conduction wires 9, and the electric connection portion of the feed wires 23 and the sliding pieces 17 are both the electric conduction portions, no problem occurs in insulation because the electric conduction portions at two spots are covered with the mold resin 24.

Embodiment 3

FIGS. 16 to 22 show Embodiment 3 of the present invention. The same numerals are provided for the same numerals as Embodiments 1 and 2, and illustration is abbreviated.

Embodiment 3 is different with respect to an arrangement of the hose 2*b* for vacuum cleaner which is connected to the grip in hand 3 compared with the arrangement in Embodiment 2. The connection tube 7*b* is integrally formed with the ring 62 in Embodiment 2, and the slip preventive portion comprising the seal groove 21 and the concave groove 19 in Embodiment 2 is inserted in the ring 62 as the slip preventive portion 65 of separate parts and is designed to be connected to the connection tube 7*b*. Further, a penetration portion 66 which is inserted in the connection tube 7*b* of the slip preventive portion 65 is designed to be brought in contact with the connection tube 7*b*.

The other ends of the feed wires 23 whose one ends were electrically connected to the electric conduction wires 9 are electrically connected to the sliding pieces 17 from the rear face side of the sliding pieces 17. The connection tube 7*b* is inserted into the inner peripheral face of the flexible hose 6, and the inner peripheral face of the connection tube 7*b* is covered with the penetration portion 66 of the slip preventive portion 65 by inserting the penetration portion 66 of the slip preventive portion 65 into the connection tube 7*b*, therefore the feed wires 23 are not forced out. As a result, when the flexible hose 6 and the connection tube 7*b* are fixed by the mold resin 24, it can be prevented that the feed wires are damaged and snapped by the mold which is inserted in the inner peripheral face of the connection tube 7*b*.

After the sliding pieces 17 are electrically connected to the electric conduction wires 9 of the flexible hose 6 by the feed wires 23 preliminarily, the connection tube 7*b* is inserted into the inner peripheral face of the flexible hose 6, therefore the length of the feed wires 23 can be shortened, and the assembly workability of the hose 2*b* for vacuum cleaner can be improved.

Since the feed wires 23 are covered with the mold resin 24, external force is not applied to the feed wires 23 and the feed wires 23 can be protected.

Figure 20:
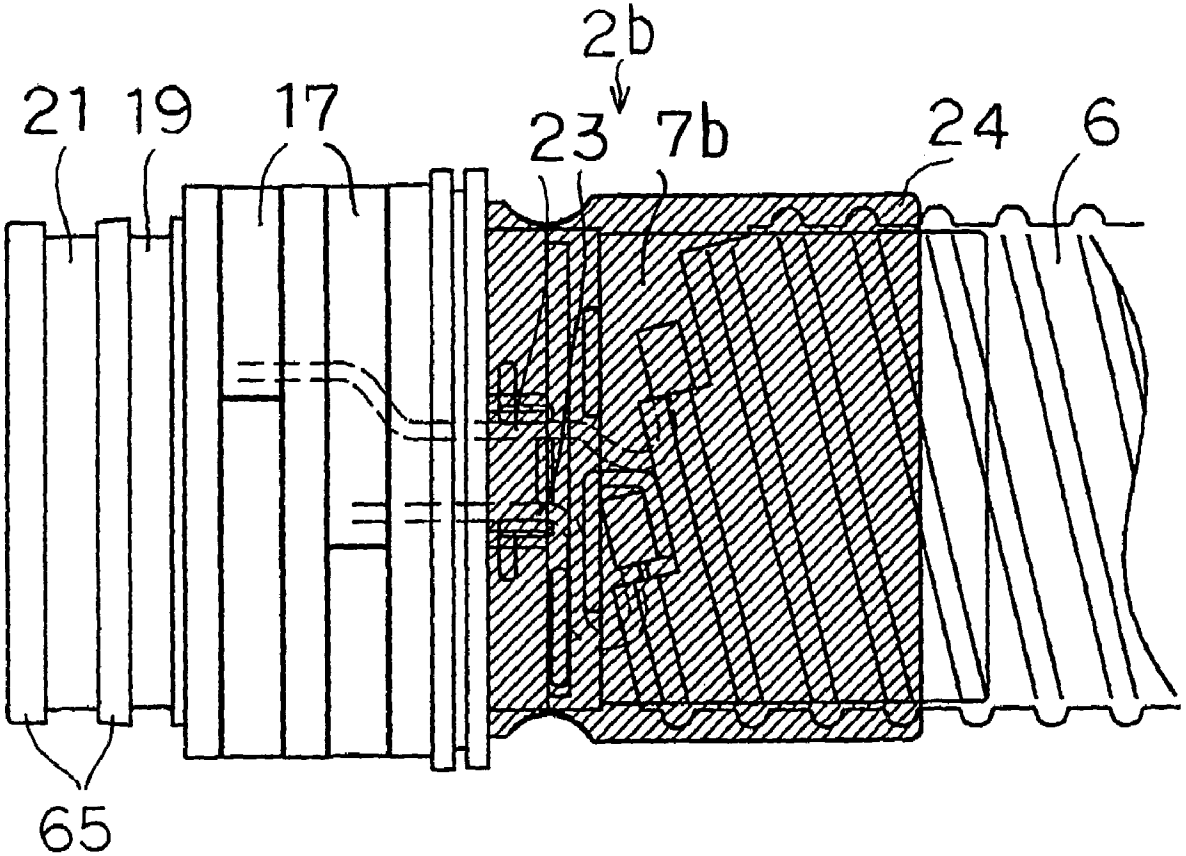
FIG. 20 is a side view of the hose for vacuum cleaner at a side connected to the same grip in hand, and shows a condition in which it was filled with a mold resin.
Figure 21:
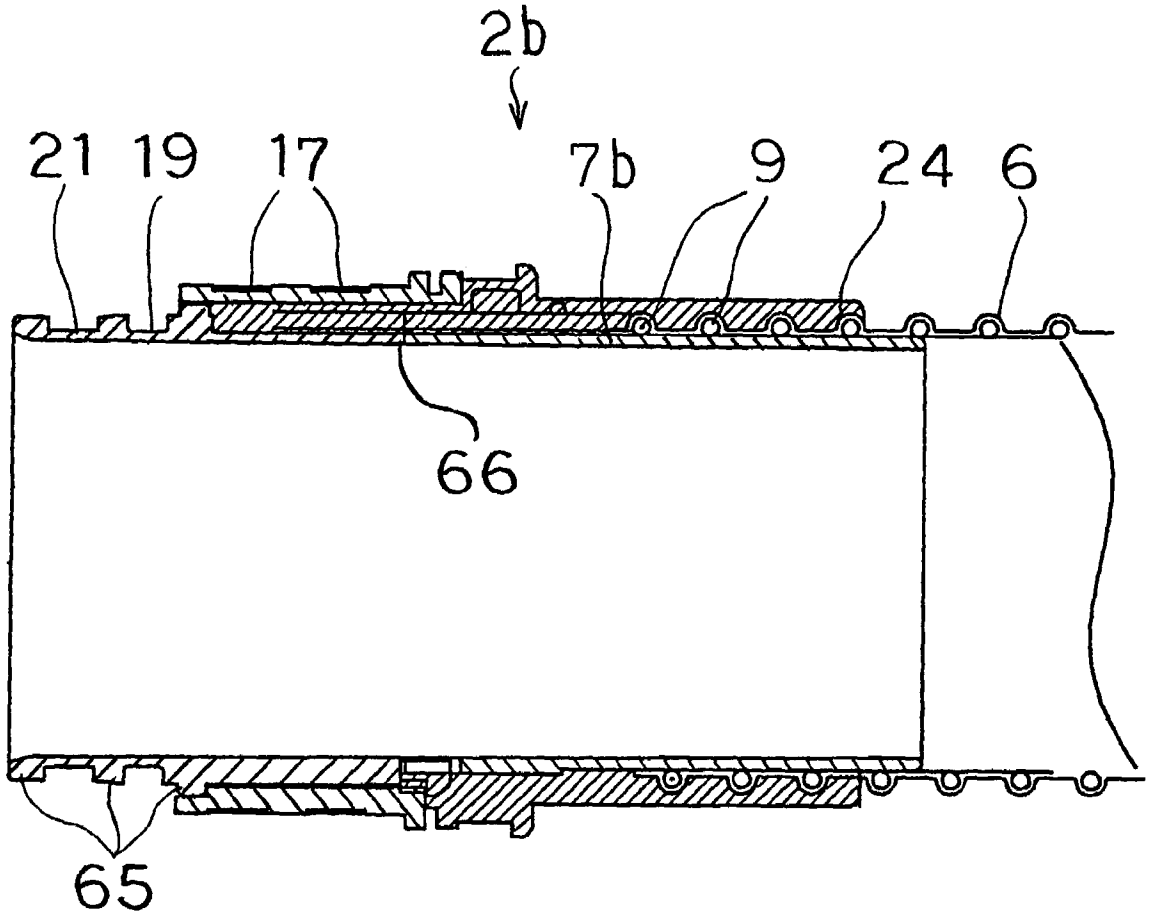
FIG. 21 is a side sectional view of a condition in which the hose for vacuum cleaner at a side connected to the same grip in hand was filled with a mold resin.
Figure 22:
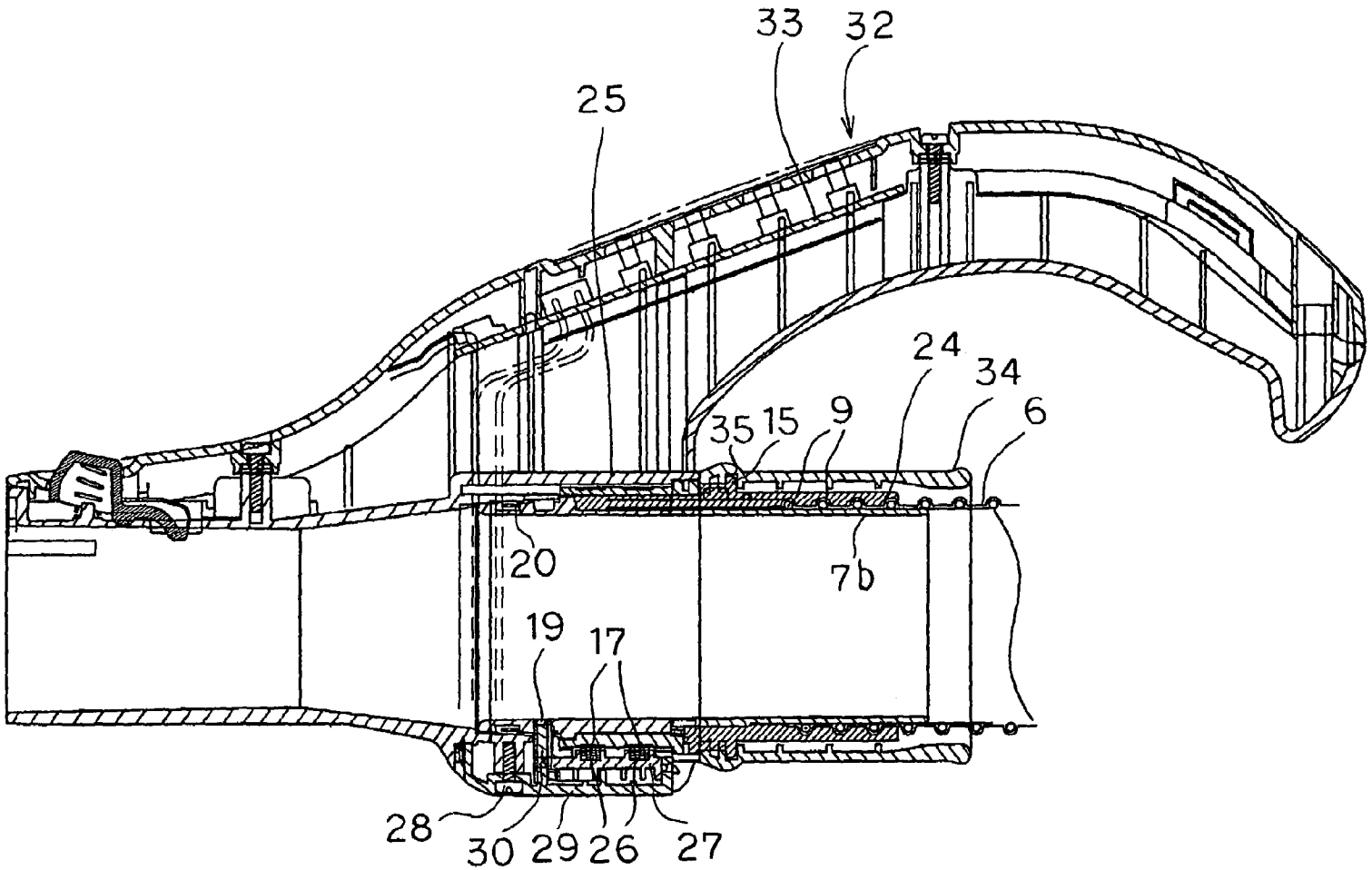
FIG. 22 is a side sectional view of a condition in which the hose for vacuum cleaner was connected to the grip in hand.

Further, since the mold resin 24 is filled in the gap between the outer peripheral face of the penetration portion 66 and the inner peripheral face of the ring 62, the slip preventive portion 65 is fixed while keeping airtightness (refer to FIGS. 20 to 22).

Embodiment 4

Figure 23:
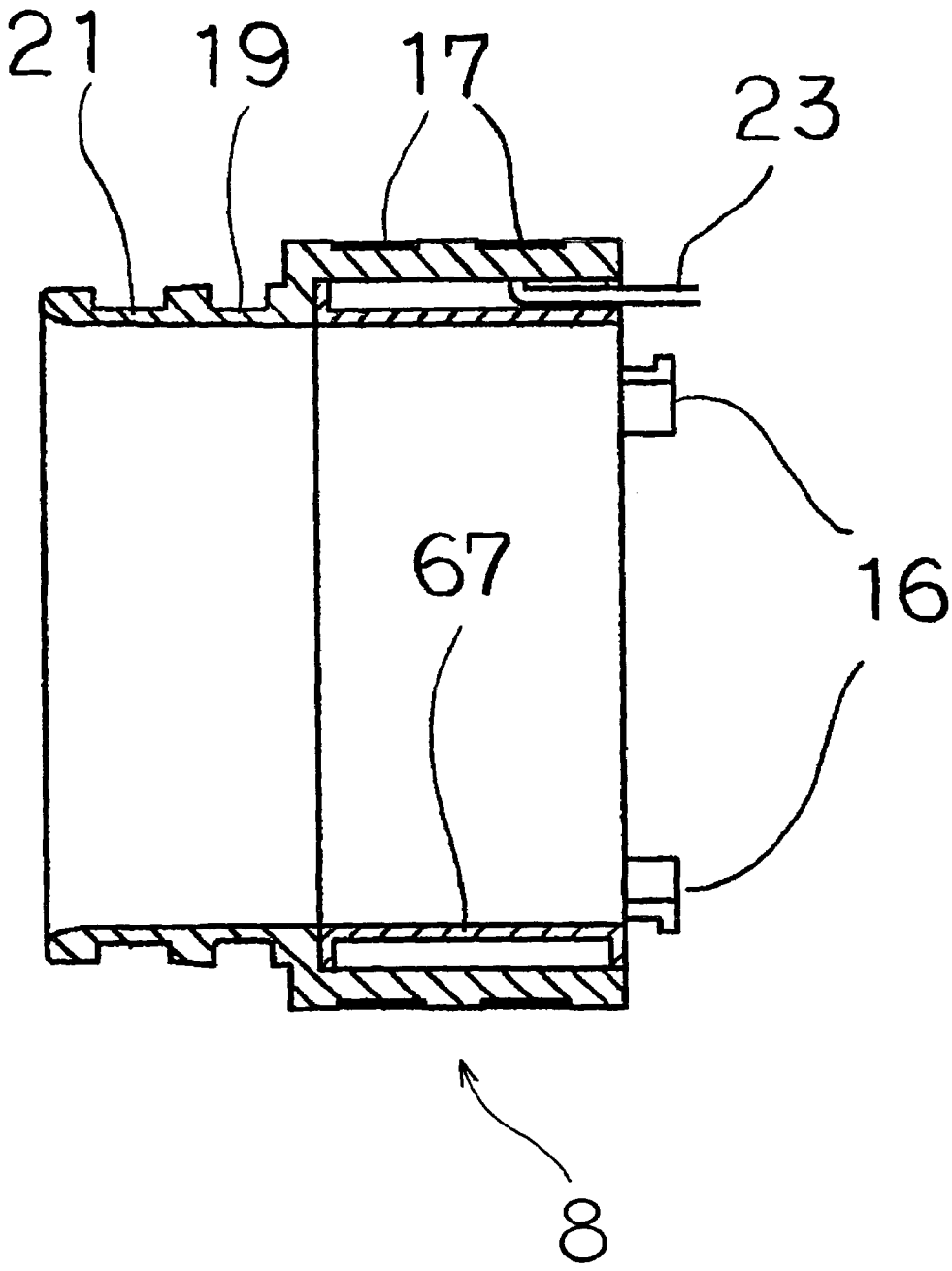
FIG. 23 is a sectional view of the base of the hose for vacuum cleaner at a side connected to a grip in hand of the vacuum cleaner of the third mode of operation of the present invention.

FIG. 23 shows Embodiment 4. The same numerals are provided for the same numerals as Embodiments 1 to 3, and illustration is abbreviated.

In Embodiment 1, since the mold resin 24 which fixes the flexible hose 6 and the connection tube 7 is filled in the connection portion of the sliding pieces 17 with the feed wires 23 of the inner peripheral face of the base 8, it is prevented that the electric conduction portion is exposed on the inner peripheral face of the hose 2 for vacuum cleaner.

In Embodiment 4, since the insulation cover 67 is mounted on the inner peripheral face facing the sliding pieces 17 of the base 8, it is prevented that the electric conduction portion is exposed on the inner peripheral face of the hose 2 for vacuum cleaner. An arrangement like this exhibits the similar effect as shown in Embodiment 1.

Though several Embodiments of the present invention are described above, it is to be understood that the present invention is not limited only to the above-mentioned, various changes and modifications may be made in the invention without departing from the sprit and scope thereof.

What is claimed is:

1. A hose for vacuum cleaner comprising:

a flexible hose having electroconductive wires;

a connection tube whose one end is connected to an inner peripheral face of the flexible hose from an end of the flexible hose and another end is exposed outside of the flexible hose;

a mold resin which fixes the flexible hose and the connection tube by being filled over from the outer peripheral face of the flexible hose nearby the end of the flexible hose to the outer peripheral face of the connection tube which is exposed outside of the flexible hose;

a tubular base which is connected to the another end of the connection tube;

sliding contact pieces which are provided at the outer peripheral face of the base and with which sliding contact points of a mounted sliding portion are electrically brought in contact in free axial rotation; and feed wires whose one end is electrically connected to the sliding contact pieces and another end is electrically connected to the electroconductive wires of the flexible hose;

wherein one end of the feed wires is connected to a connection portion of the sliding contact pieces which penetrate through the outer peripheral face of the base to the inner peripheral face of the base;

wherein said mold resin fills a gap between the outer peripheral face of the connection tube and the inner peripheral face of the base.

2. The hose for vacuum cleaner as claimed in claim 1, wherein said feed wires are covered with the mold resin.

3. The hose for vacuum cleaner as claimed in claim 1, wherein the one end of the connection tube has an insertion portion inserted into the end of the flexible hose, and wherein an end face of the mold resin on the outer peripheral face of the flexible hose is positioned at the end side of the flexible hose rather than extending over the outer periphery of the hose to the position of the end of the insertion portion of the connection tube in the flexible hose.

4. The hose for vaccum cleaner as claimed in claim 1, wherein said mold resin is composed of a substantially transparent material.

5. A hose for vacuum cleaner comprising:

a flexible hose having electroconductive wires;

a connection tube whose one end is connected to an inner peripheral face of the flexible hose from an end of the flexible hose and another end is exposed outside of the flexible hose;

a mold resin which fixes the flexible hose and the connection tube by being filled over from the outer peripheral face of the flexible hose nearby the end of the flexible hose to the outer peripheral face of the connection tube which is exposed outside of the flexible hose;

a tubular ring being formed so as to freely slide on the outer peripheral face of the connection tube;

sliding contact pieces being provided at the outer peripheral face of the ring and with which the sliding contact points of a mounted sliding portion are electrically brought in contact in free rotation;

feed wires whose one end is electrically connected to the sliding contact pieces and another end is electrically connected to the electroconductive wires of the flexible hose; and a positioning means which is formed in the connection tube and positions the ring at a fixed position of the connection tube;

wherein one end of the feed wires is connected to a connection portion of the sliding contact pieces which penetrate through the outer peripheral face of the ring to the inner peripheral face of the ring;

wherein said mold resin fills a gap between the outer peripheral face of the connection tube and the inner peripheral face of the ring.

6. The hose for vacuum cleaner as claimed in claim 5, wherein said feed wires are covered with the mold resin.

7. The hose for vacuum cleaner as claimed in claim 5, wherein the one end of the connection tube has an insertion portion inserted into the end of the flexible hose, and wherein an end face of the mold resin on the outer peripheral face of the flexible hose is positioned at the end side of the flexible hose rather than extending over the outer periphery of the hose to the position of the end of the insertion portion of connection tube in the flexible hose.

8. The hose for vacuum cleaner as claimed in claim 5, wherein said mold resin is composed of a substantially transparent material.

9. A hose for vacuum cleaner comprising;

a flexible hose having electroconductive wires;

a connection tube whose one end is connected to an inner peripheral face of the flexible hose from an end of the flexible hose and another end is exposed outside of the flexible hose;

a mold resin which fixes the flexible hose and the connection tube by being filled over from the outer peripheral face of the flexible hose nearby the end of the flexible hose to the outer peripheral face of the connection tube which is exposed outside of the flexible hose;

a tubular slip preventive member having a concave groove which cooperates with a slip preventive mechanism within a mounted portion;

a ring integrally formed with the connection tube having sliding contact pieces at the outer peripheral face with which sliding contact points of the mounted portion are brought in electrical mechanical contact in free axial rotation;

feed wires whose one end is electrically connected to the sliding contact pieces another end is electrically connected to the electroconductive wires of the flexible hose;

wherein the slip preventive member is inserted in the ring and one end of the feed wires is connected to a connection portion of the sliding contact pieces which penetrate the outer peripheral face of the ring through to the inner peripheral face of the ring;

wherein the mold resin fills gaps between the outer peripheral face of the connection tube, the outer peripheral face of the slip preventive member and the inner peripheral face of the ring.

10. The hose for vacuum cleaner as claimed in claim 9, wherein said feed wires are covered with the mold resin.

11. The hose for vacuum cleaner as claimed in claim 9, wherein the one end of the connection tube has an insertion portion inserted into the end of the flexible hose, and wherein an end face of the mold resin on the outer peripheral face of the flexible hose is positioned at the end side of the flexible hose rather than extending over the outer periphery of the hose to the position of the end of the insertion portion of the connection tube in the flexible hose.

12. The hose for vacuum cleaner as claimed in claim 9, wherein said mold resin is composed of a substantially transparent material.

13. The hose for vacuum cleaner as claimed is claim 9, wherein the feed wires are arranged such that they are not forced out in the inner peripheral face of the vacuum cleaner hose during insertion of the slip preventive member into the ring.

14. The hose for vacuum cleaner as claimed in claim 13, wherein the one end of the connection tube has an insertion portion inserted into the end of the flexible hose, and wherein an end face of the mold resin on the outer peripheral face of the flexible hose is positioned at the end side of the flexible hose rather than extending over the outer periphery of the hose to the position of the end of the insertion portion of the connection tube in the flexible hose.

15. The hose for vacuum cleaner as claimed is claim 13, wherein said feed wires are covered with the mold resin.

16. The hose for vacuum cleaner as claimed in claim 15, wherein the one end of the connection tube has an insertion portion inserted into the end of the flexible hose, and wherein an end face of the mold resin on the outer peripheral face of the flexible hose is positioned at the end side of the flexible hose rather than extending over the outer periphery of the hose to the position of the end of the insertion portion of the connection tube in the flexible hose.

17. The hose for vacuum cleaner as claimed in claim 16, wherein said mold resin is composed of a substantially transparent material.

* * * * *